US005531532A

United States Patent [19]

Umbach

[11] Patent Number: 5,531,532

[45] Date of Patent: Jul. 2, 1996

[54] PRINTER AND A PRINTER WITH A FASTENING DEVICE FOR ATTACHING A PERIPHERAL DEVICE TO THE PRINTER

[75] Inventor: Dirk Umbach, Hattingen, Germany

[73] Assignee: Esselte Meto International GmbH, Heppenheim, Germany

[21] Appl. No.: 310,157

[22] Filed: Sep. 21, 1994

[30] Foreign Application Priority Data

Sep. 24, 1993 [DE] Germany ..... 43 32 575.0

[51] Int. Cl.[6] ..... B41J 29/02

[52] U.S. Cl. ..... 400/692; 346/145; 364/708.1

[58] Field of Search ..... 400/88, 691, 692, 400/693, 624, 605; 346/145; 347/108, 109, 170, 222, 263; 364/708.1

[56] References Cited

U.S. PATENT DOCUMENTS

| | | | |
|---|---|---|---|
| 4,634,304 | 1/1987 | Narushima et al. | 400/697 |
| 4,881,839 | 11/1989 | Grimm | 400/692 |
| 5,107,401 | 4/1992 | Youn | 364/708.1 |
| 5,150,166 | 9/1992 | Matsuura et al. | 355/308 |
| 5,186,558 | 2/1993 | Sherman et al. | 400/88 |

FOREIGN PATENT DOCUMENTS

| | | | |
|---|---|---|---|
| 0230758 | 8/1987 | European Pat. Off. . | |
| 8513629 | 8/1985 | Germany . | |
| 3816350 | 11/1989 | Germany . | |
| 3936261 | 5/1990 | Germany | 364/708.1 |
| 61-293879 | 12/1986 | Japan | 400/692 |
| 63-021175 | 1/1988 | Japan | 400/692 |
| 63-95973 | 4/1988 | Japan . | |
| 61-197682 | 8/1988 | Japan | 364/708.1 |
| 2221898 | 2/1990 | Japan | 400/692 |
| 343267 | 2/1991 | Japan . | |
| 2177069 | 1/1987 | United Kingdom | 400/692 |
| 2196300 | 4/1988 | United Kingdom . | |

*Primary Examiner*—David A. Wiecking
*Attorney, Agent, or Firm*—Thomas N. Ljungman

[57] ABSTRACT

A connecting element for a printer housing has housing parts which are connected to one another by at least one connecting element, into which connecting element is integrated a locator device in the form of a T-slot for anchoring peripheral devices to the housing of the printer. Peripheral devices can be detachably connected to the locator device either directly or indirectly by means of an anchor plate.

20 Claims, 16 Drawing Sheets

PRINTER AND A PRINTER WITH A FASTENING DEVICE FOR ATTACHING A PERIPHERAL DEVICE TO THE PRINTER

BACKGROUND OF THE INVENTION

1. Field of the Invention

The present invention relates to a printer, in particular an impact dot matrix, ink jet, laser or thermal transfer printer, with a printer housing and at least one connecting element provided on the printer housing, which connecting element has a locator device for an anchoring element for the attachment of an additional device or a peripheral unit.

2. Background Information

If a printer is used intensively, in particular for business purposes, additional devices or peripheral units are frequently required, such as cutting devices for labels, stackers to hold fan-fold paper, spools for winding and unwinding, feed rollers for printer paper, etc. In the past, these additional devices were bolted to the printer housing or simply placed next to it. Therefore, it would be a useful feature if the user were able to change the configuration of such a printer, adding peripheral devices as necessary.

One such device is disclosed in Japanese Patent 63 95973 A. In accordance with Japanese Patent 63 95973, a paper feed device is fastened to the upper side of a printer housing by means of a cylindrical pin which is engaged in a fork-shaped opening of the printer housing. One disadvantage of such an arrangement is that this fastening device makes it possible to attach peripheral devices essentially only to the top of the unit, since the peripheral device is held in place generally only by means of gravity.

OBJECT OF THE INVENTION

The object of the present invention is therefore to modify the printer of the type described above so that peripheral devices can be installed in essentially any orientation on the printer housing easily, quickly and securely.

SUMMARY OF THE INVENTION

The present invention teaches that this object can be achieved by means of a printer housing which includes at least two housing parts, which two housing parts are preferably connected to one another by means of a connecting element having a locator device, so that a slot is formed between the two housing parts, through which slot the locator device is accessible.

One or more peripheral devices can preferably be connected as necessary to such a locator device by means of an anchoring element. In some cases, essentially no additional installation space is necessary, and essentially no additional modifications need to be made to the printer housing itself, e.g. in the form of threaded holes. The provision of a locator device on the connecting element is also advantageous to the extent that all sorts of different peripheral devices can preferably be fastened to the printer housing, so that a separate connecting element is essentially not necessary for each peripheral device. Such a connecting element can be provided on virtually any printer housing.

The connecting element and the locator device are also advantageously accessible from outside, i.e. from outside the printer housing. This accessibility can be accomplished simply if the printer housing includes two or more housing parts which can be held together by the connecting element, and the housing parts are at a certain distance from one another, so that they leave a slot open between them, through which the connecting element is preferably accessible.

The connecting element and the locator device can preferably be advantageously manufactured in one piece, and can preferably be made of metal, generally of extruded aluminum. Of course, other metals or rigid plastics may be suitable, provided that they are sufficiently rigid.

Further, the locator device can advantageously be configured in the form of a T-slot.

The connection can be advantageously achieved by having an anchoring element fastened to the locator device, preferably detachably, e.g. by clamping, bolting, suspending, screwing it in, snap-in clips, etc. The anchoring element is preferably an anchor plate, in particular a flat steel anchor plate. At least one peripheral device can be connected in turn to the anchoring element. The attachment of the peripheral device can be accomplished in particular by means of a detachable connection, e.g. by bolting, suspension, screwing it in or snapping it into place.

In this manner, it is possible to detachably fasten one or more peripheral units to an anchor plate, which is in turn engaged in a locator device such as a T-slot inside the printer housing. This type of connection is simple, user-friendly and makes it possible to quickly and easily change the configuration of the printer, whereby the connection is essentially identical for different peripheral devices. Several peripheral devices can also be fastened simultaneously, either to an anchor plate or to several anchor plates which are detachably fastened to, or in the locator device.

One aspect of the invention resides broadly in a printer, such as a retail printer, for printing an image on a carrier, the printer comprising: a housing; means for printing an image onto a carrier; the printing means being disposed at the housing; means for moving the carrier towards and away from said printing means; means for attaching at least one peripheral device to the housing; the means for attaching comprising: means for anchoring the at least one peripheral device to the housing; slot means for receiving the anchoring means; the slot means being disposed along at least a portion of the housing; the anchoring means being slidably disposable within the slot means; and means for retaining the anchoring means within the slot means.

Another aspect of the invention resides broadly in a printer, such as a computer printer, for printing an image on a carrier, the printer comprising: means for receiving information from an output means, such as a computer; means for storing information from the output means; first means for transferring the information received by the receiving means from the output means to the storing means; a housing; means for printing an image onto a carrier; the printing means being disposed at the housing; second means for transferring the information received from the output means from the storing means to the printing means; means for moving the carrier towards and away from the printing means; means for attaching at least one peripheral device to the housing; the means for attaching comprising: means for anchoring the at least one peripheral device to the housing; slot means for receiving the anchoring means; the slot means being disposed along at least a portion of the housing; the anchoring means being slidably disposable within the slot means; and means for retaining the anchoring means within the slot means.

Yet another aspect of the invention resides broadly in a method of attaching at least one peripheral device to a printer, the printer comprising: a housing; means for printing an image onto a carrier; the printing means being disposed at the housing; means for moving the carrier towards and away from the printing means; means for attaching at least one peripheral device to the housing; the means for attaching comprising: means for anchoring the at least one peripheral device to the housing; slot means for receiving the anchoring means; the slot means being disposed along at least a portion of the housing; the anchoring means being slidably disposable within the slot means; and means for retaining the anchoring means within the slot means; the method comprising the steps of: providing the housing; providing the printing means; providing the carrier; printing an image onto the carrier with the printing means; disposing the printing means at the housing; providing the moving means; moving the carrier towards and away from the printing means with the moving means; providing the at least one peripheral device; providing the attaching means; providing the anchoring means; providing the slot means; providing the retaining means; the method further comprising the steps of: disposing the slot means along at least a portion of the housing; disposing the anchoring means in the slot means; positioning the anchoring means in the slot means by sliding the anchoring means along the slot means; retaining the anchoring means in the slot means with the retaining means; and attaching the at least one peripheral device to the housing with the attaching means.

BRIEF DESCRIPTION OF THE DRAWINGS

Additional advantages, features and details of the invention are indicated in the following description, in which preferred embodiments of the present invention are explained in greater detail with reference to the accompanying drawings in which.

DESCRIPTION OF THE PREFERRED EMBODIMENTS

Figure 1:
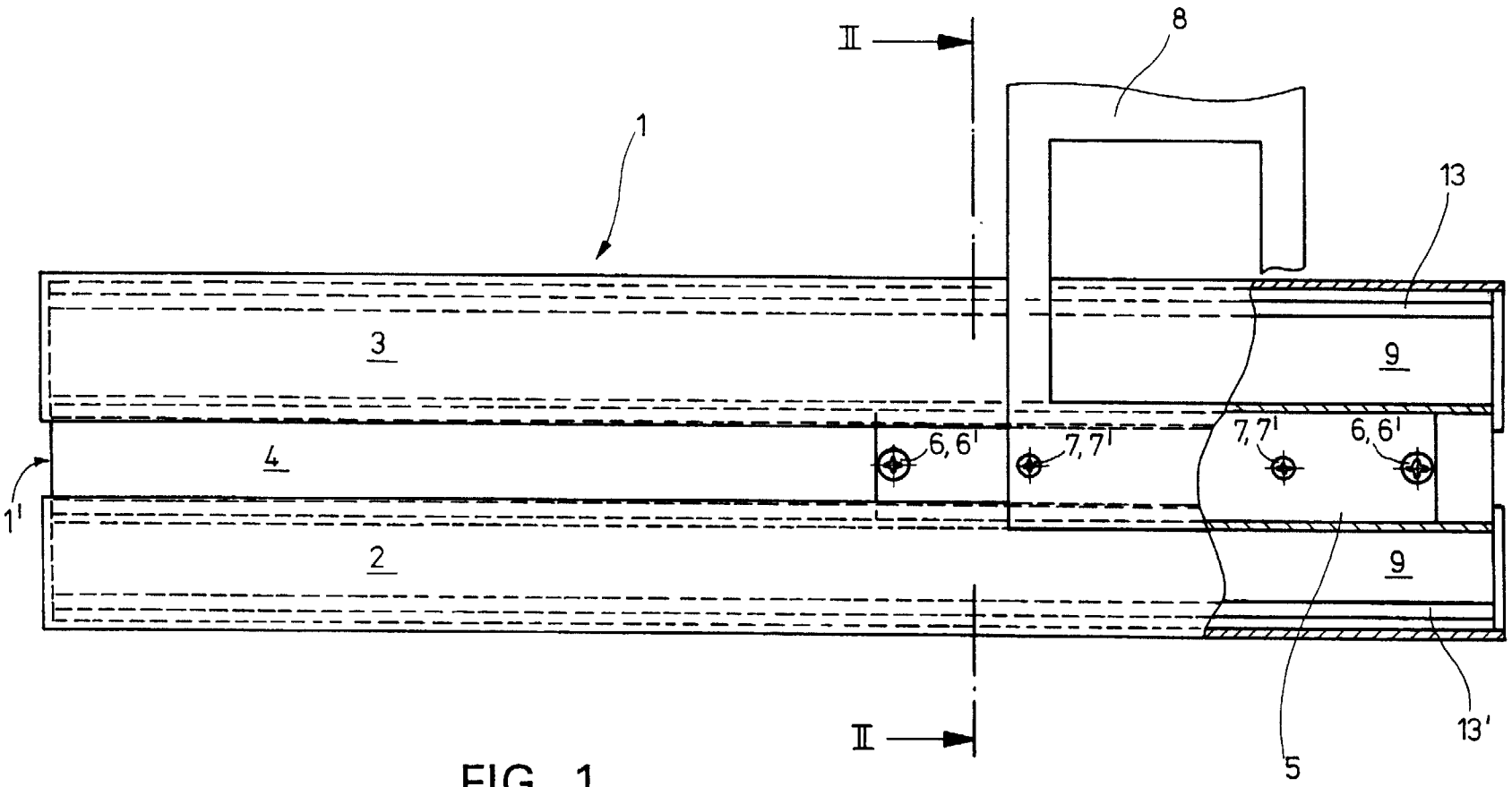
FIG. 1 shows a printer housing with an anchor plate and peripheral device, whereby the right-hand portion of the housing wall is shown in cross section along Line I—I in FIG. 2.
Figure 2:
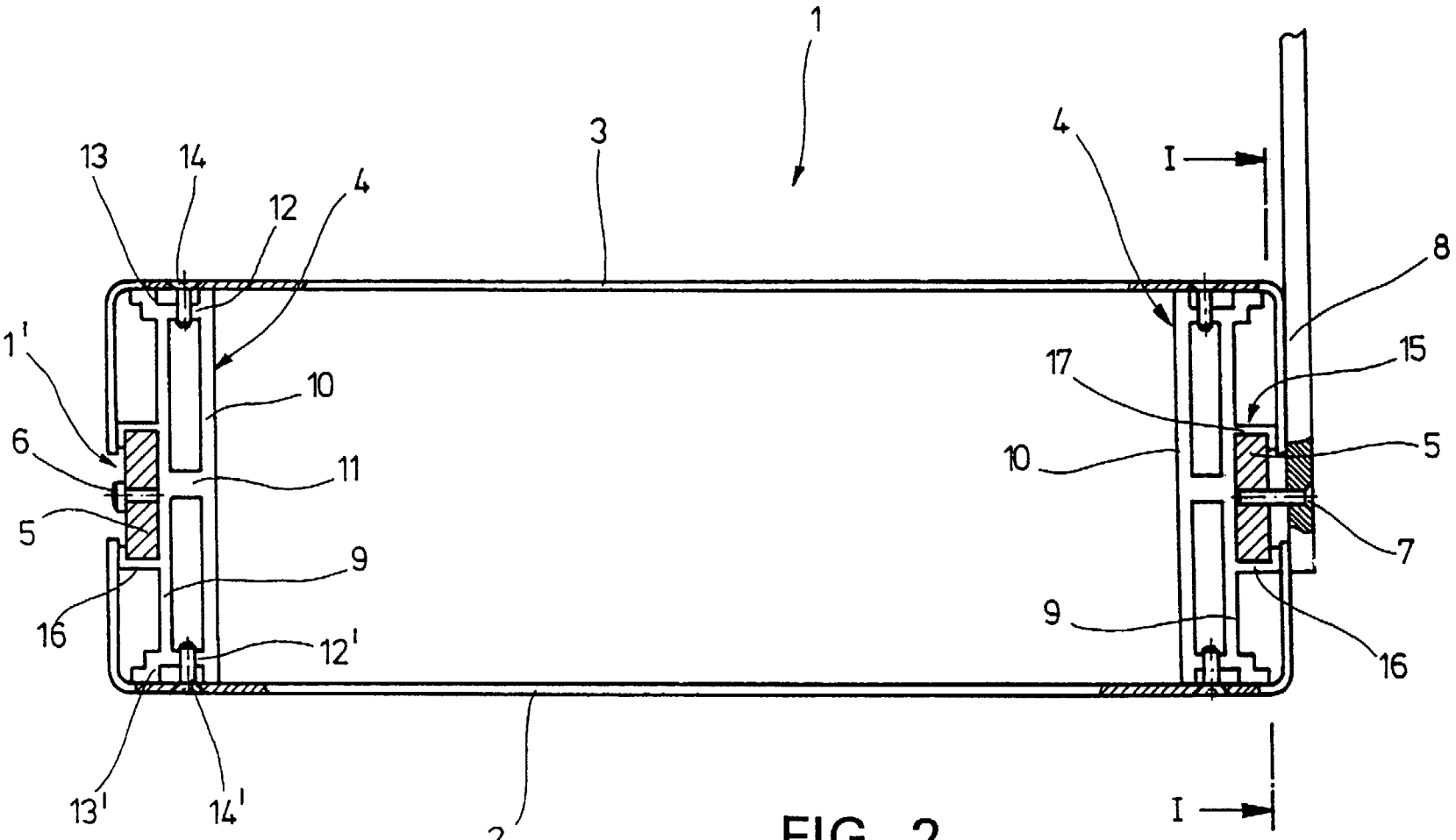
FIG. 2 shows a longitudinal section through a printer housing as claimed by the invention, along Line II—II in FIG. 1.

The printer housing 1, which is schematically illustrated in FIGS. 1 and 2, in this case for what could be a thermal transfer printer, preferably includes a lower housing part 2 and an upper housing part 3, both of which can preferably be designed in the form of shells. The two housing parts 2 and 3 can preferably be connected to one another by means of two connecting elements 4, so that there is a certain distance between the two housing parts 2 and 3, which distance can preferably be in the form of a slot 1'. In the embodiment described above, these connecting elements 4 can preferably be profile elements which can be made of an extruded metal, such as aluminum extrusions. Of course, other materials may be utilized, such as rigid plastics, steel, or steel alloys.

Each of these connecting or profile elements 4 can preferably include a front, or outwardly disposed, plate 9 and a rear, or inwardly disposed, plate 10, which front plate 9 and rear plate 10 can extend substantially vertically through the printer housing 1, essentially between the housing parts 2 and 3. The two plates 9, 10 can preferably be connected to one another by a middle transverse web 11, an upper transverse web 12, and a lower transverse web 12'. The upper transverse web 12 and the lower transverse web 12' can preferably be extended forward, i.e. in the direction of the slot 1', to form step-like supporting elements 13, 13'. The step-like supporting elements 13 and 13' can preferably be supported against the upper housing part 3 or the lower housing part 2, respectively. The rear plate 10 can also preferably be extended beyond the transverse webs 12, 12' by way of substantially vertical extensions 10' (see FIG. 2*a*), which vertical extensions 10' can preferably be supported against the upper housing part 3 or the lower housing part 2. The housing parts 2 and 3 can preferably be fastened to the profile elements 4 by some sort of attachment device, such as, for example, screws 14, 14'. The screws 14 and 14' can preferably penetrate the housing parts 3 and 2 and the transverse webs 12 and 12', respectively.

Figure 2A:
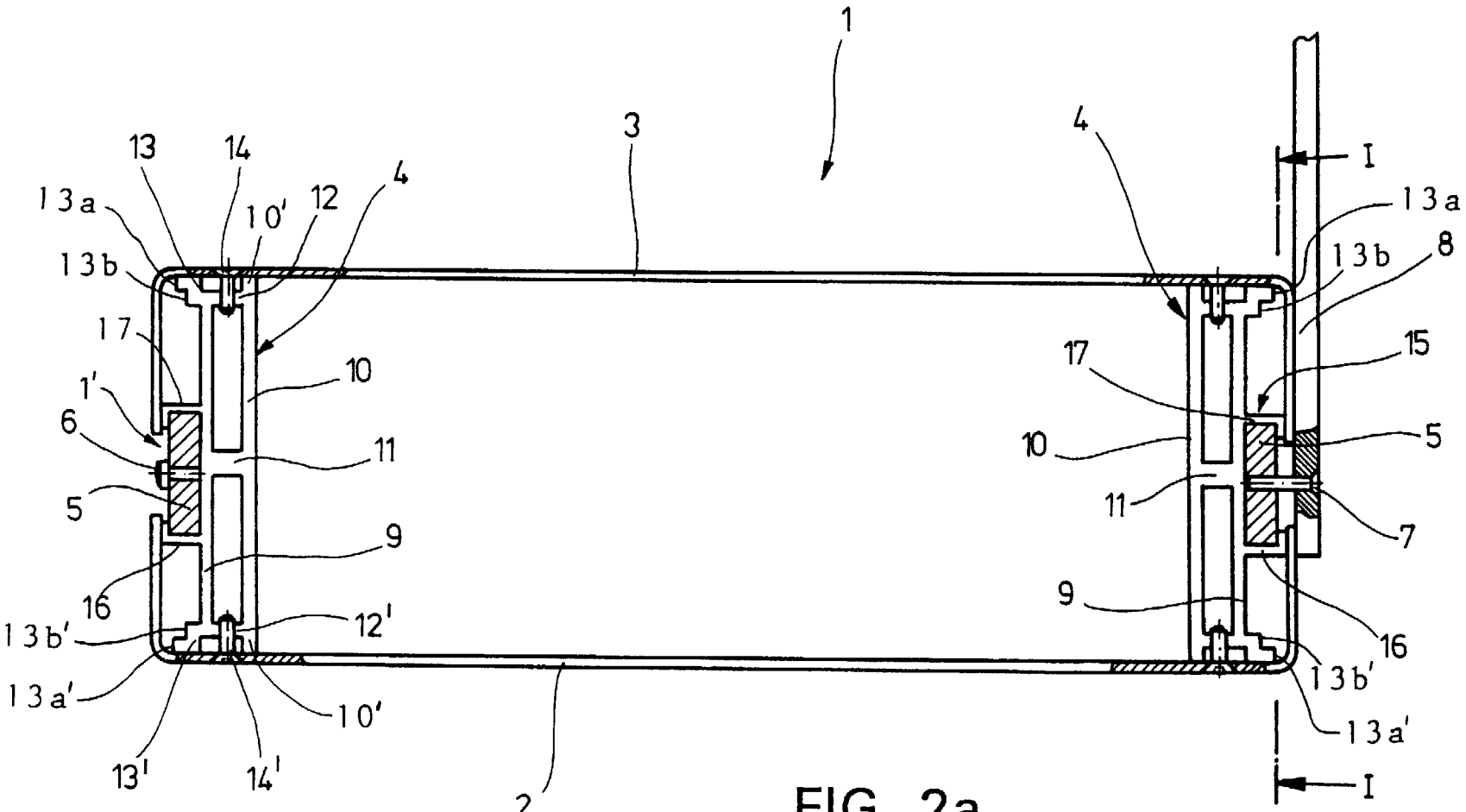
FIG. 2*a* shows substantially the same view as FIG. 2, but shows additional components.
Figure 2B:
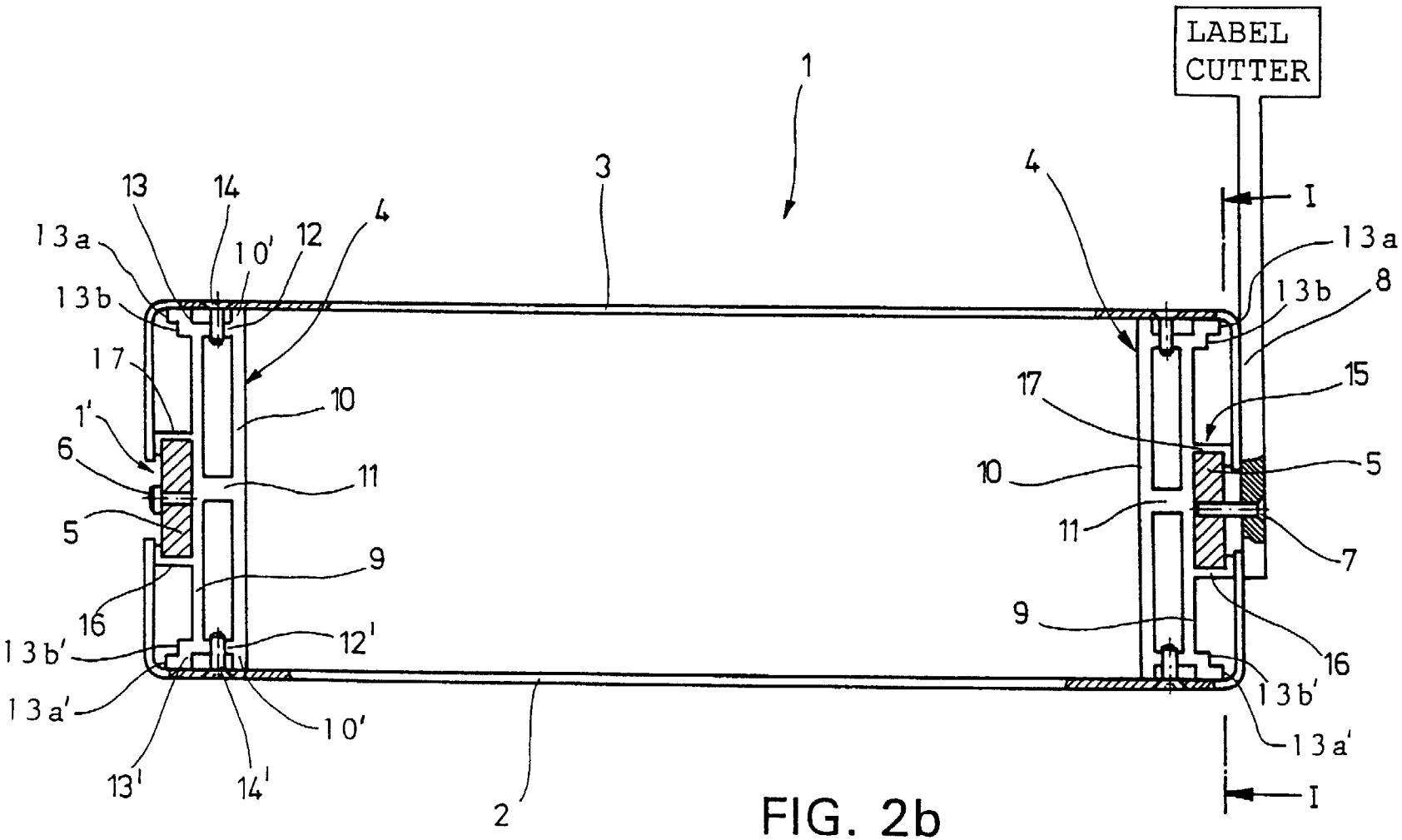
FIGS. 2*b*, 2*c*, 2*d*, 2*e*, 2*f*, 2*g*, 2*h*, 2*i* and 2*j* show various peripheral devices used in conjunction with the present invention.
Figure 2C:
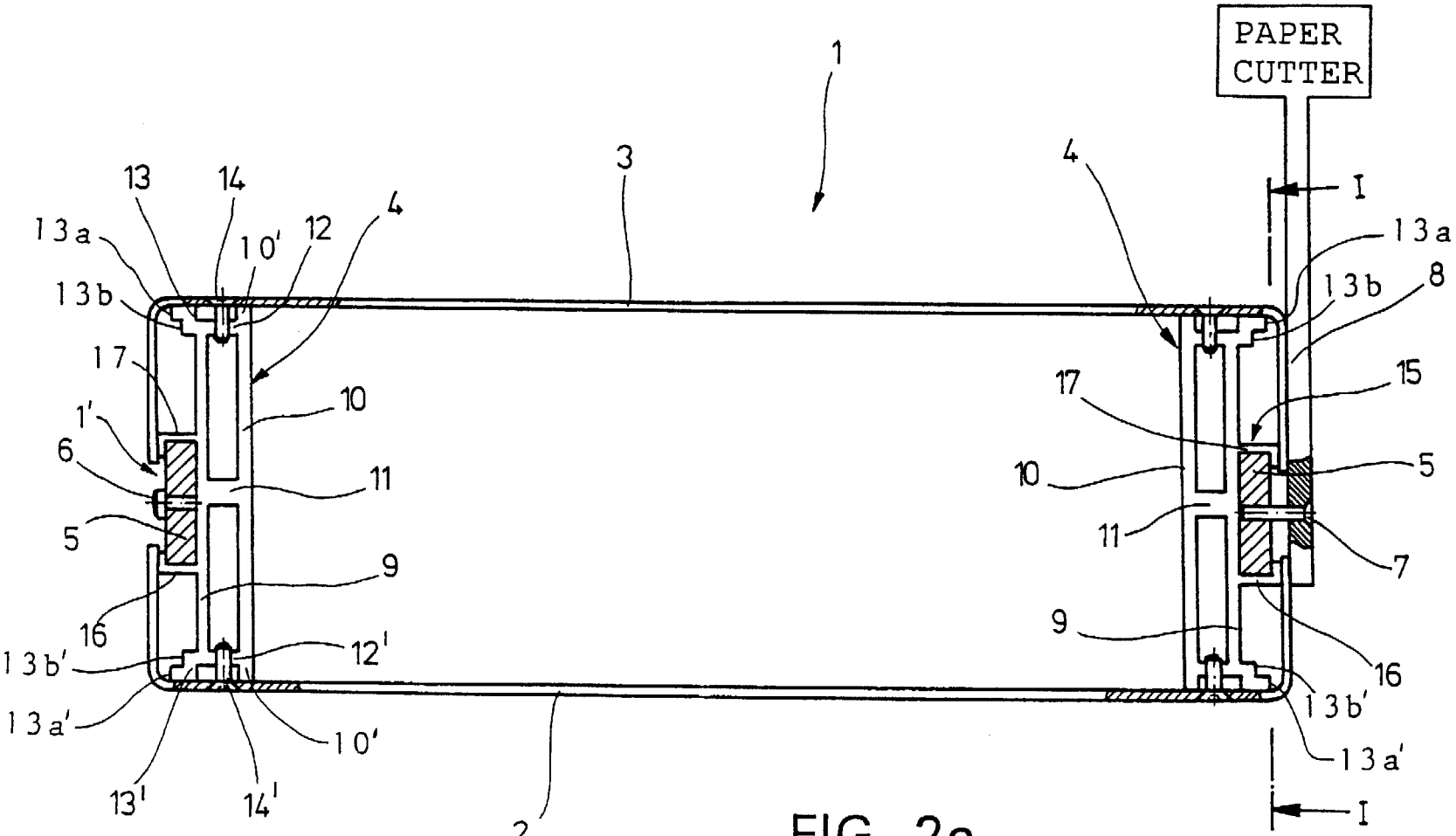
Figure 2D:
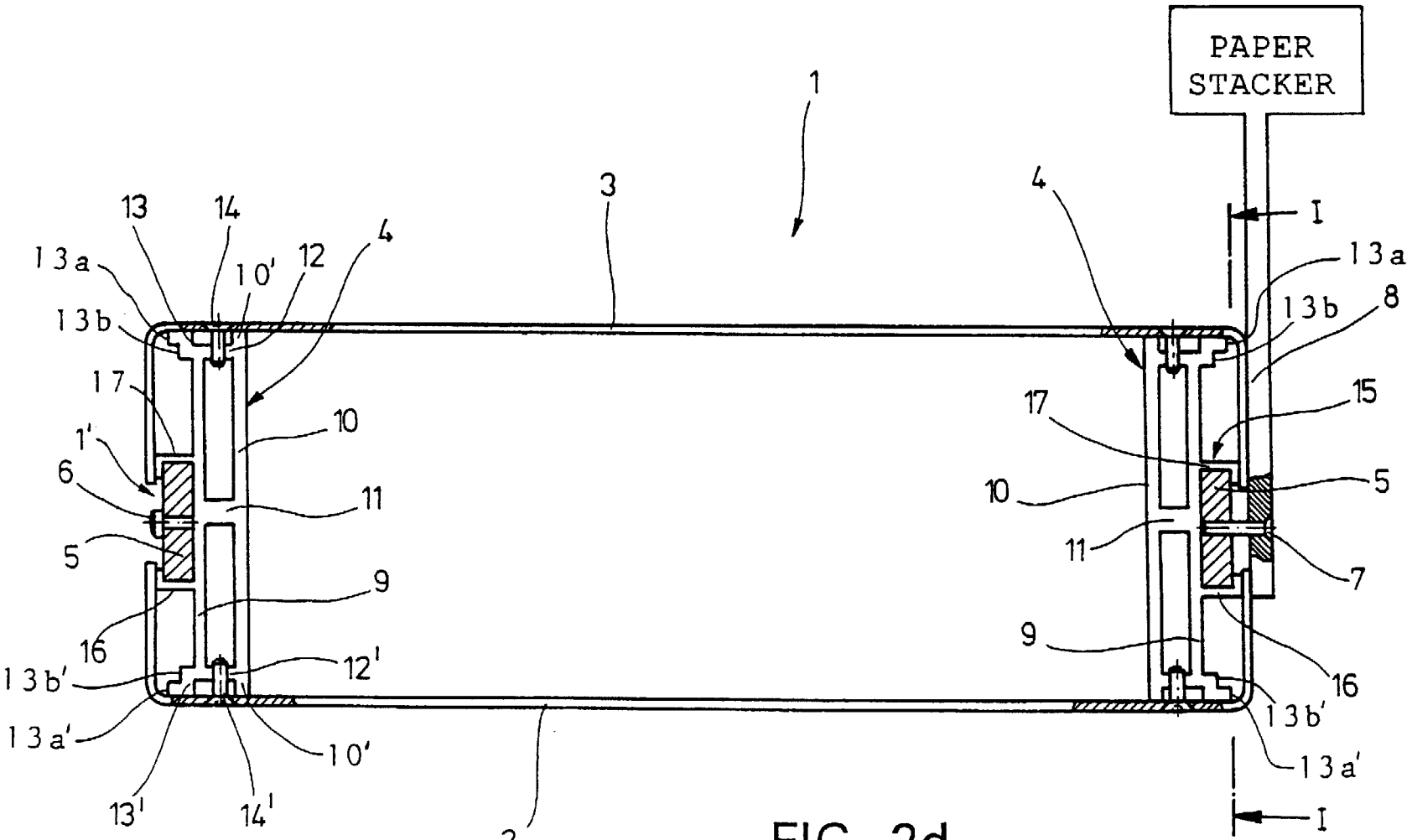
Figure 2E:
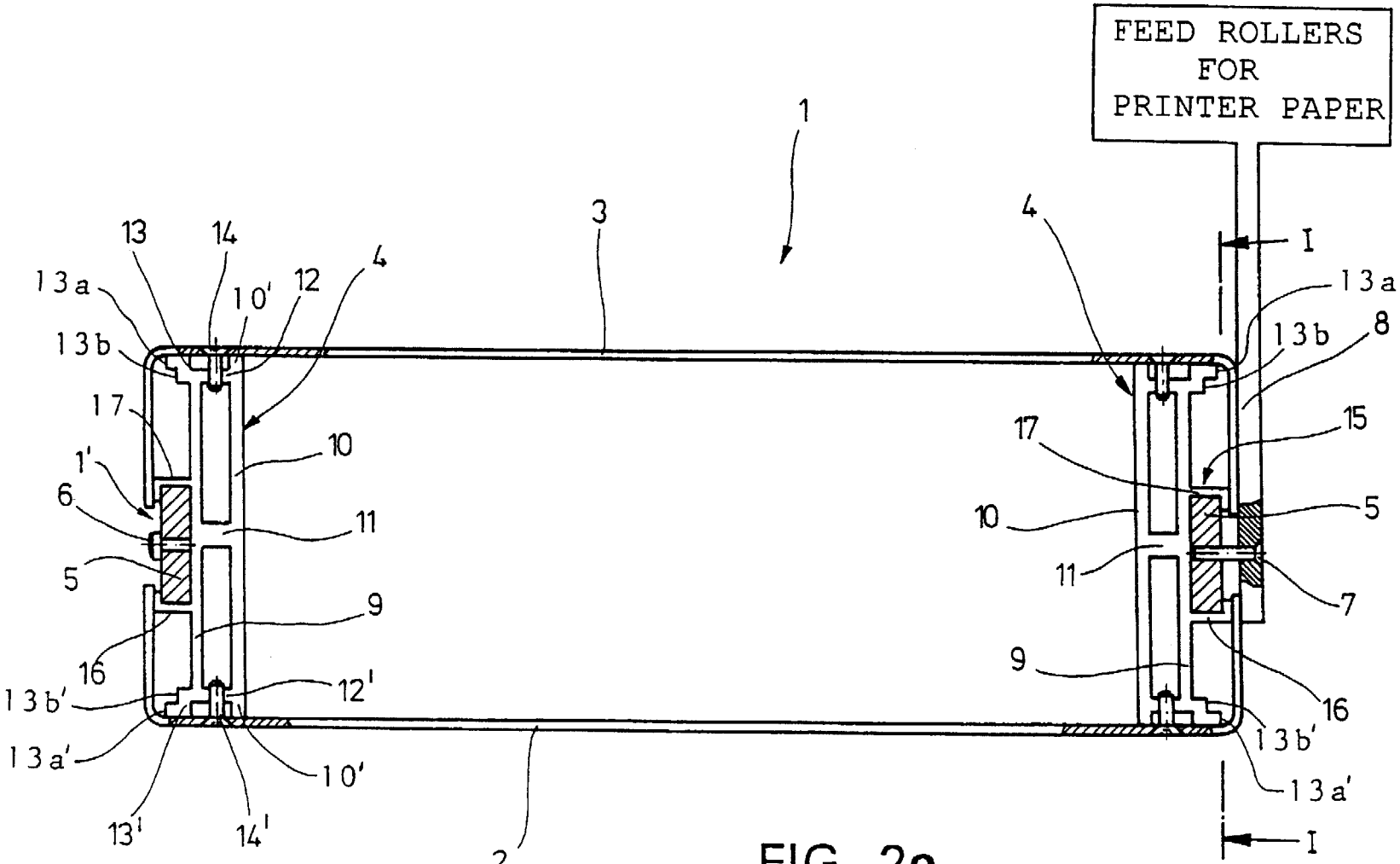
Figure 2F:
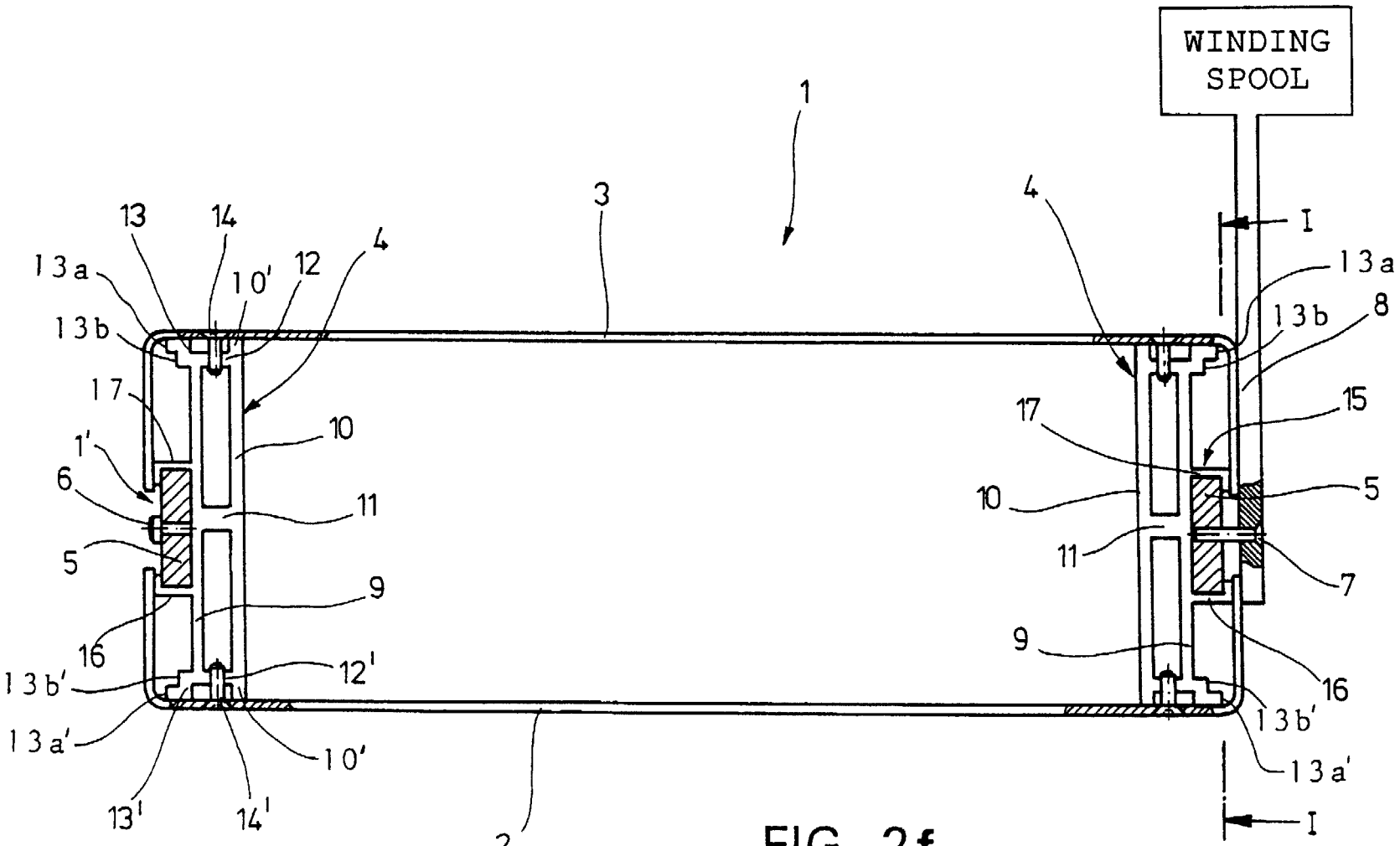
Figure 2G:
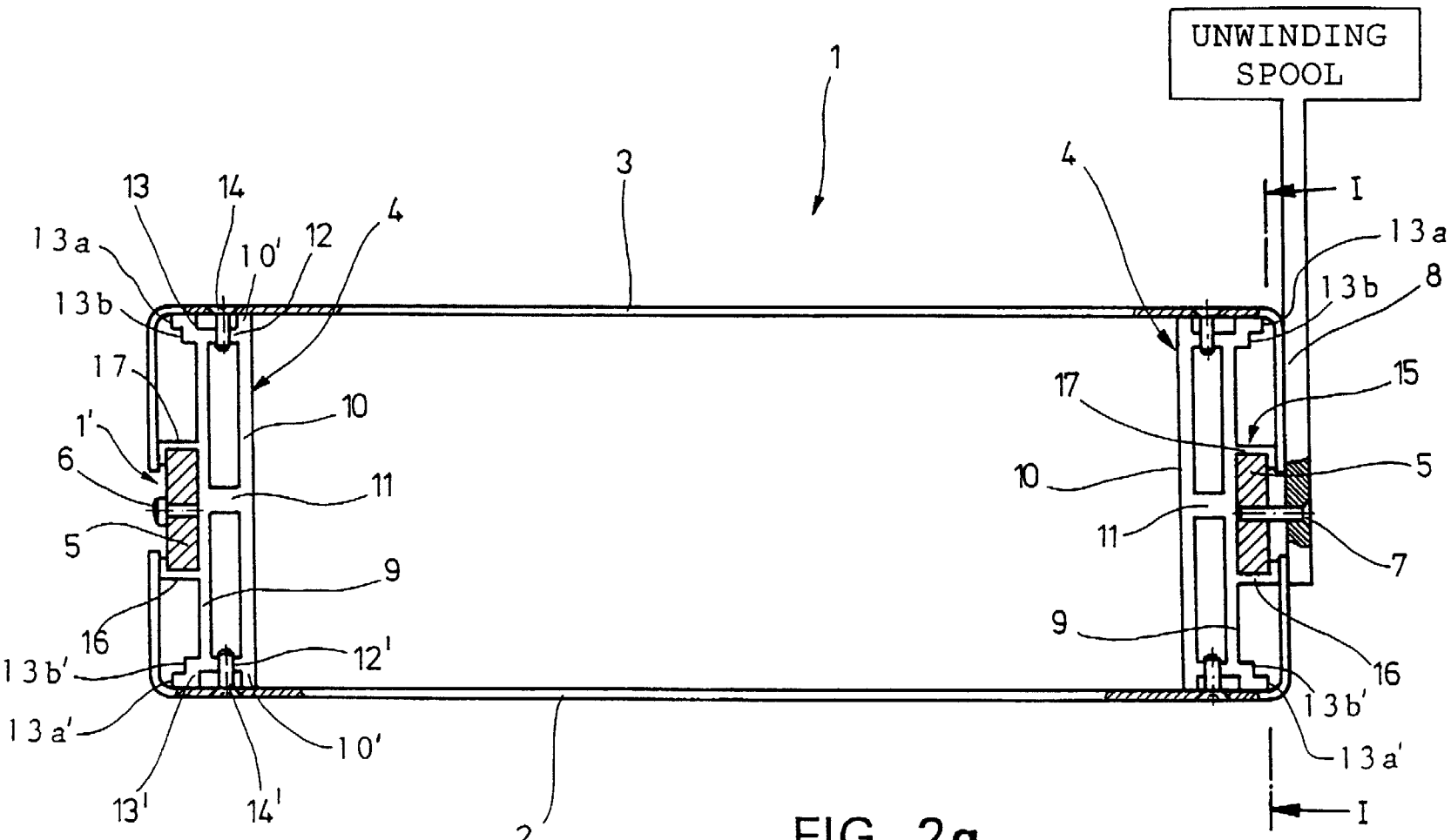
Figure 2H:
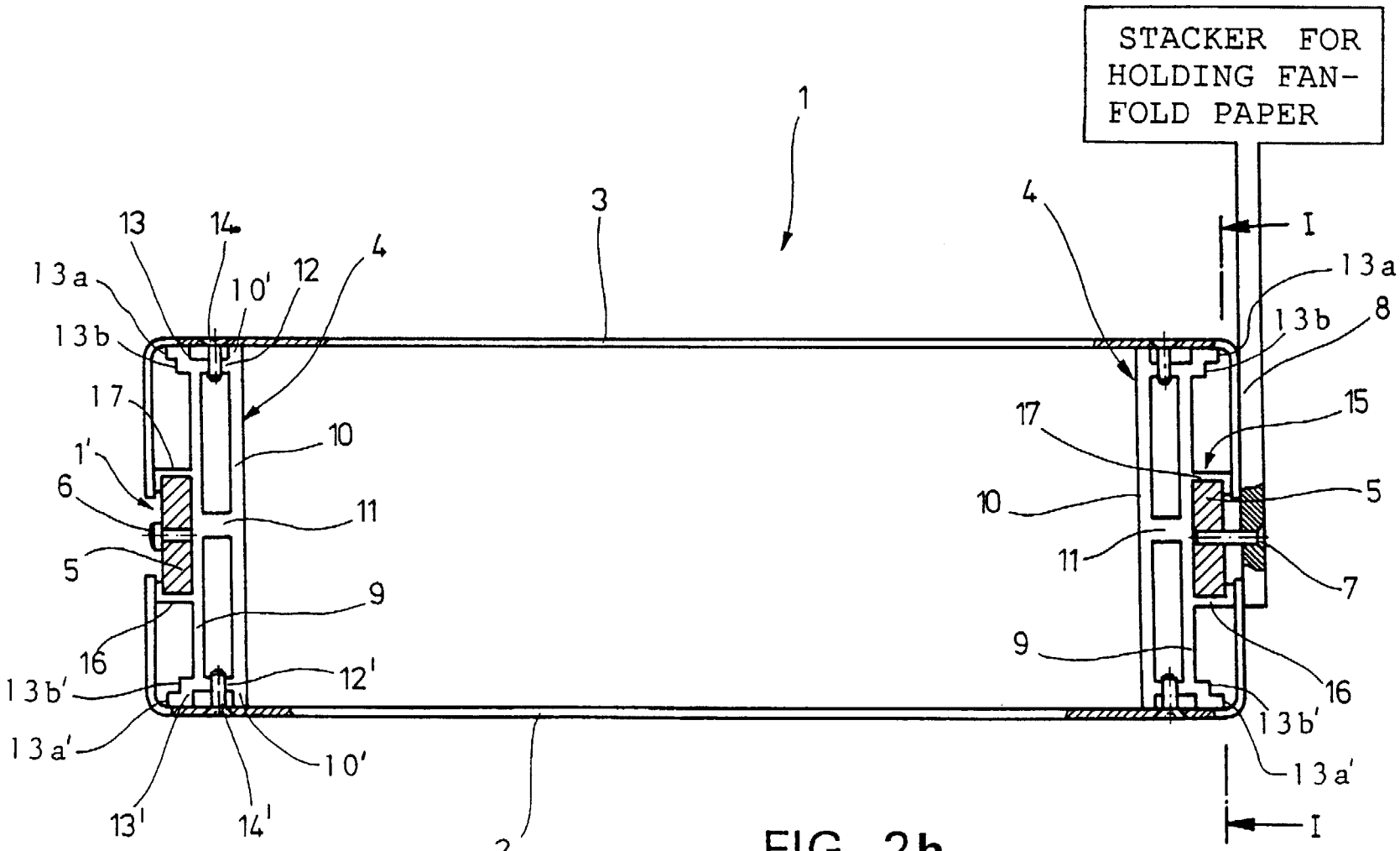
Figure 2I:
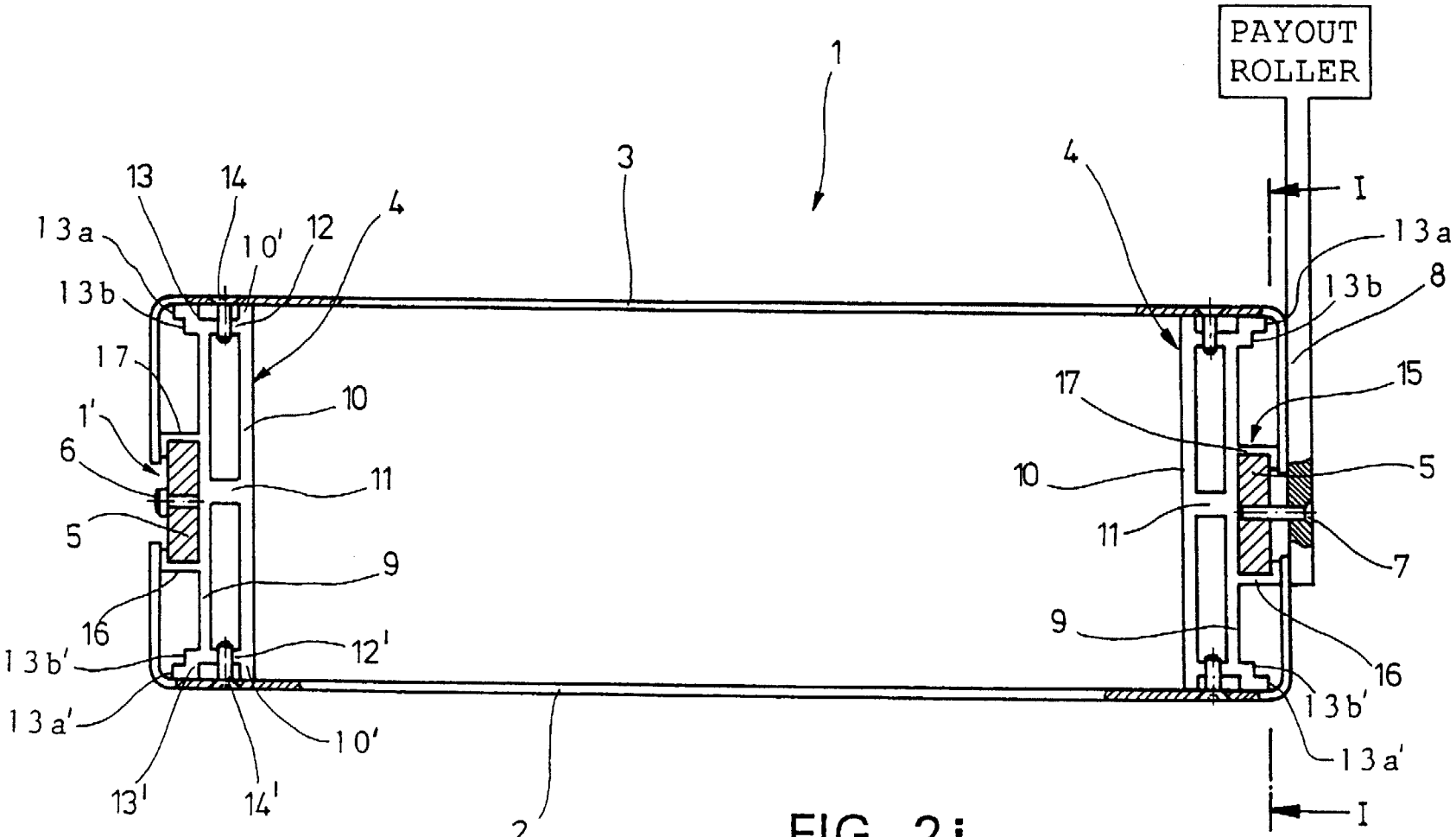
Figure 2J:
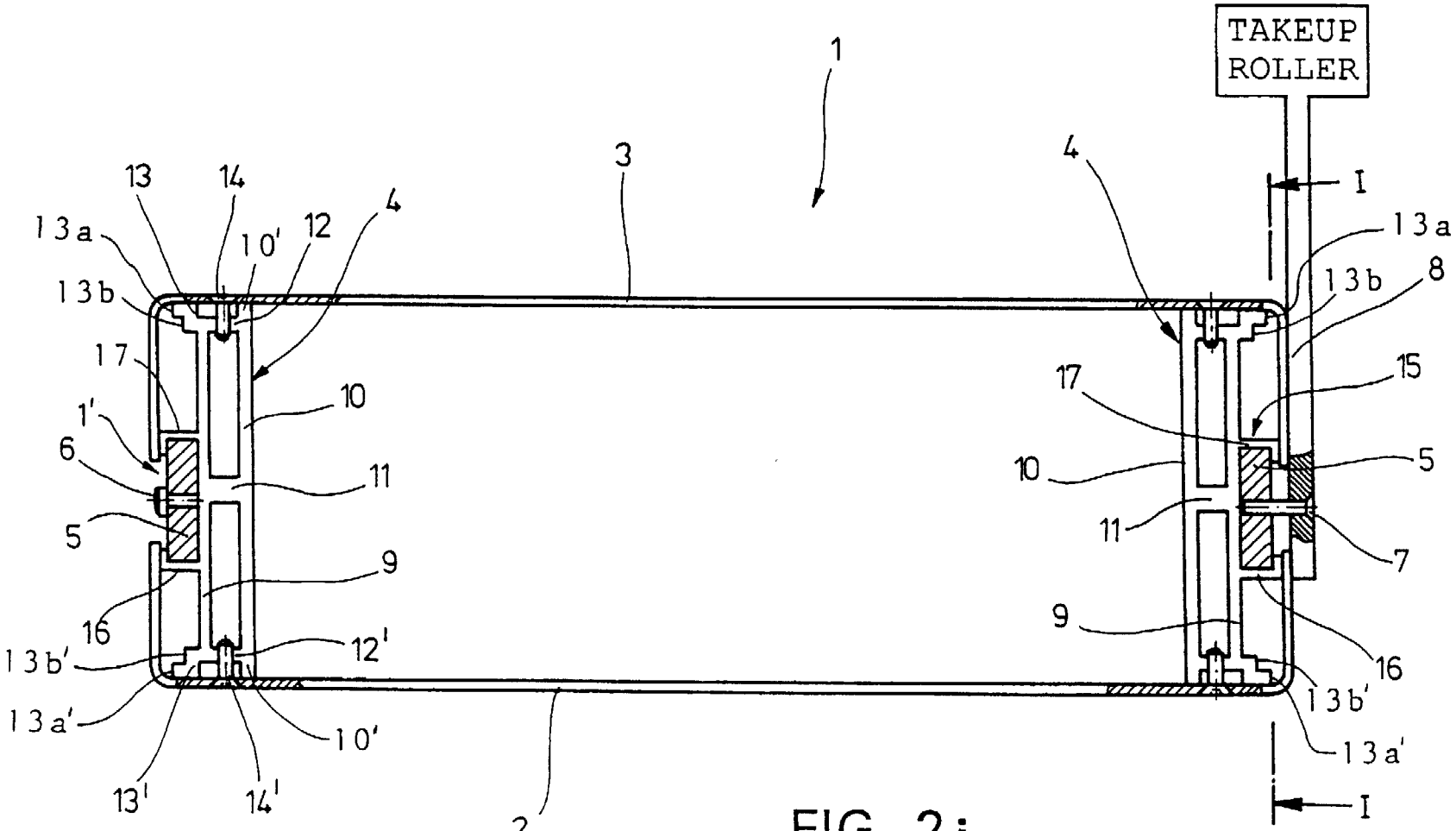

In accordance with at least one preferred embodiment of the present invention as shown in FIG. 2*a*, support element 13 can preferably have stepped portions 13*a* and 13*b*, with portion 13*a* preferably being disposed adjacent the upper housing 3. In addition, support element 13' can also preferably have stepped portions 13*a*' and 13*b*', with portion 13*a*' preferably being disposed adjacent the lower housing 2.

The front or forward plate 9 can preferably have a locator device 15 which can be configured in the form of a T-slot, which T-slot can formed by a lower rail 16 and an upper rail 17. The lower rail 16 and the upper rail 17 can preferably be manufactured as one piece with the plate 9 of the profile elements 4. The rails 16, 17 can preferably be oriented so that they are at approximately the same distance from the middle transverse web 11, so that the T-slot is approximately in the middle of the plate 9, which affords the advantage that the two preferably shell-like housing parts 2 and 3 can be of an essentially identical design. Alternatively, if the housing parts 2 and 3 would not be identical, various alternative locations of the T-slot with respect to the web 11 would be possible along the vertical height of the anchor plate 9.

Each profile element 4 is essentially configured to accept an anchor plate 5 in the T-slot thereof. The anchor plate 5 shown on the left in FIG. 2 can preferably be fastened into the T-slot, for example, by clamping it in place with screws 6. For purposes of simplicity, only one screw 6 is shown in the cross section in FIG. 2. Thus, additional screws 6 can preferably be utilized to attach an anchor plate 5 to a profile element 4. Further, anchor plate 5 may be made of steel, or another suitable metal, or a rigid material, such as a rigid plastic.

To the left of the break line in FIG. 1, the housing parts 2 and 3 are shown closed, and to the right of the break line, the housing parts 2 and 3 are broken off, providing a view of the profile element 4 and the anchor plate 5. The anchor plate 5 can preferably have threaded holes 6' and 7', and can preferably be moved, possibly by sliding horizontally, in the rails 16, 17 of the T-slot in the profile element 4. The anchor plate 5 can be introduced laterally through the slot 1', between the housing parts 2 and 3 and the profile element 4, positioned by moving the anchor plate 5 as desired, and clamped in place by means of the screws 6. To the right of the break line, FIG. 1 shows the plate 9 of the profile element 4, on which the locator device 15 is formed, into which the anchor plate 5 can preferably be inserted and fastened by means of the screws 6.

A peripheral device 8, which is illustrated only schematically in the figures, can preferably be fastened to the anchor plate 5 by means of screws 7. FIG. 2 shows, in a partial section, only one screw 7. Such a peripheral device 8, e.g. a cutter, can be for example a paper cutter or a cutter for labels or a stacker for fan-fold paper or even a feed roller for printer paper, or a payout or takeup roller. Naturally, other peripheral devices are also conceivable in accordance with the present invention.

The screws 6 and the screws 7 can preferably be provided with different diameters, so that the attachment of the peripheral device 8 is a particularly simple process. Alternatively, instead of different diameters, different threads etc. are of course also conceivable. Likewise, there can also be several threads 7' or threaded holes 7' preferably for the attachment of the peripherals 8. Several peripherals 8 can also be fastened to one anchor plate 5 at one time.

Figure 1A:
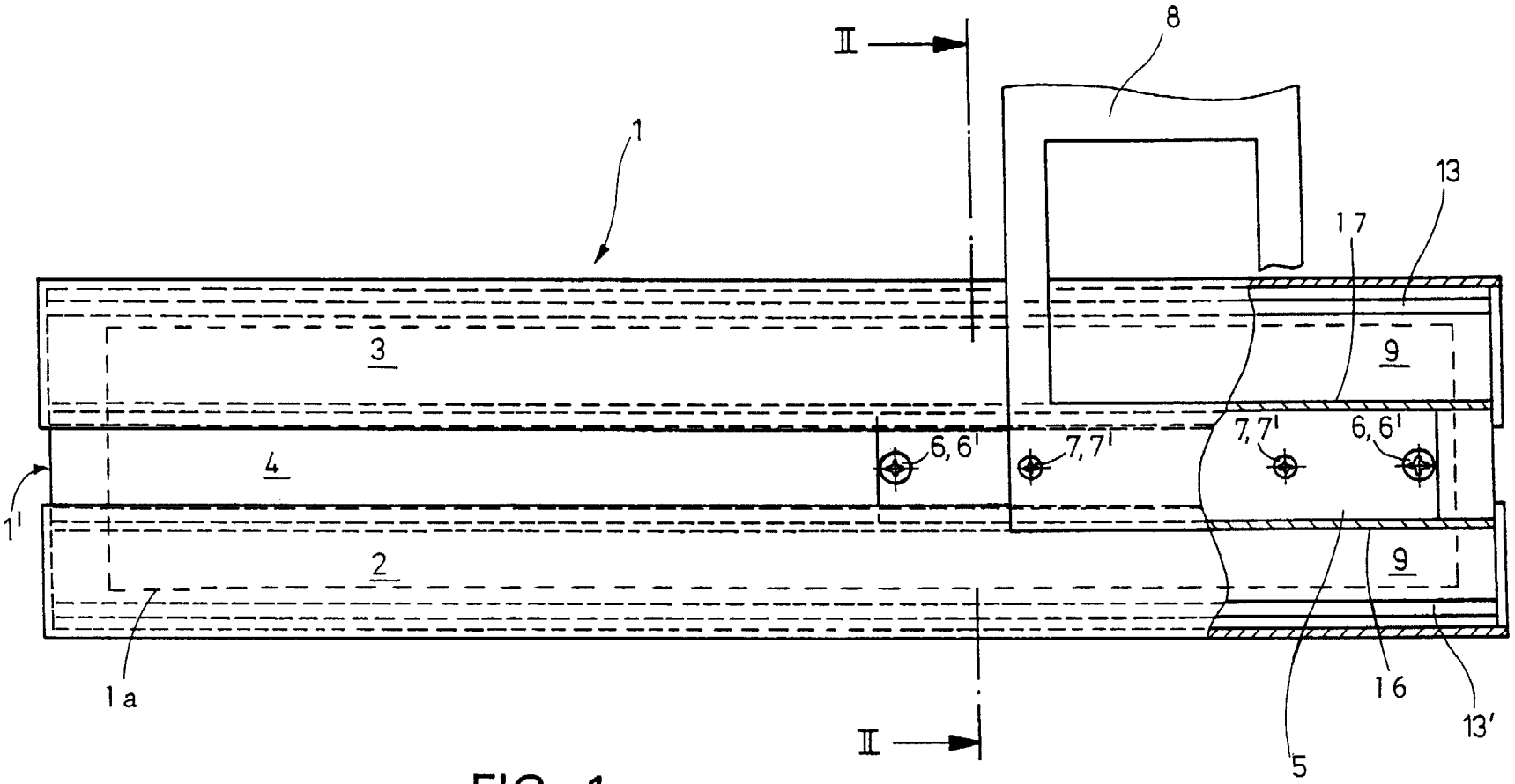
FIG. 1*a* shows substantially the same view as FIG. 1, but shows additional components.

FIG. 1*a* shows substantially the same view as FIG. 1, but shows a schematic representation of various components 1*a* of one type of thermal printer which could be utilized in accordance with at least one embodiment of the present invention.

Figure 1B:
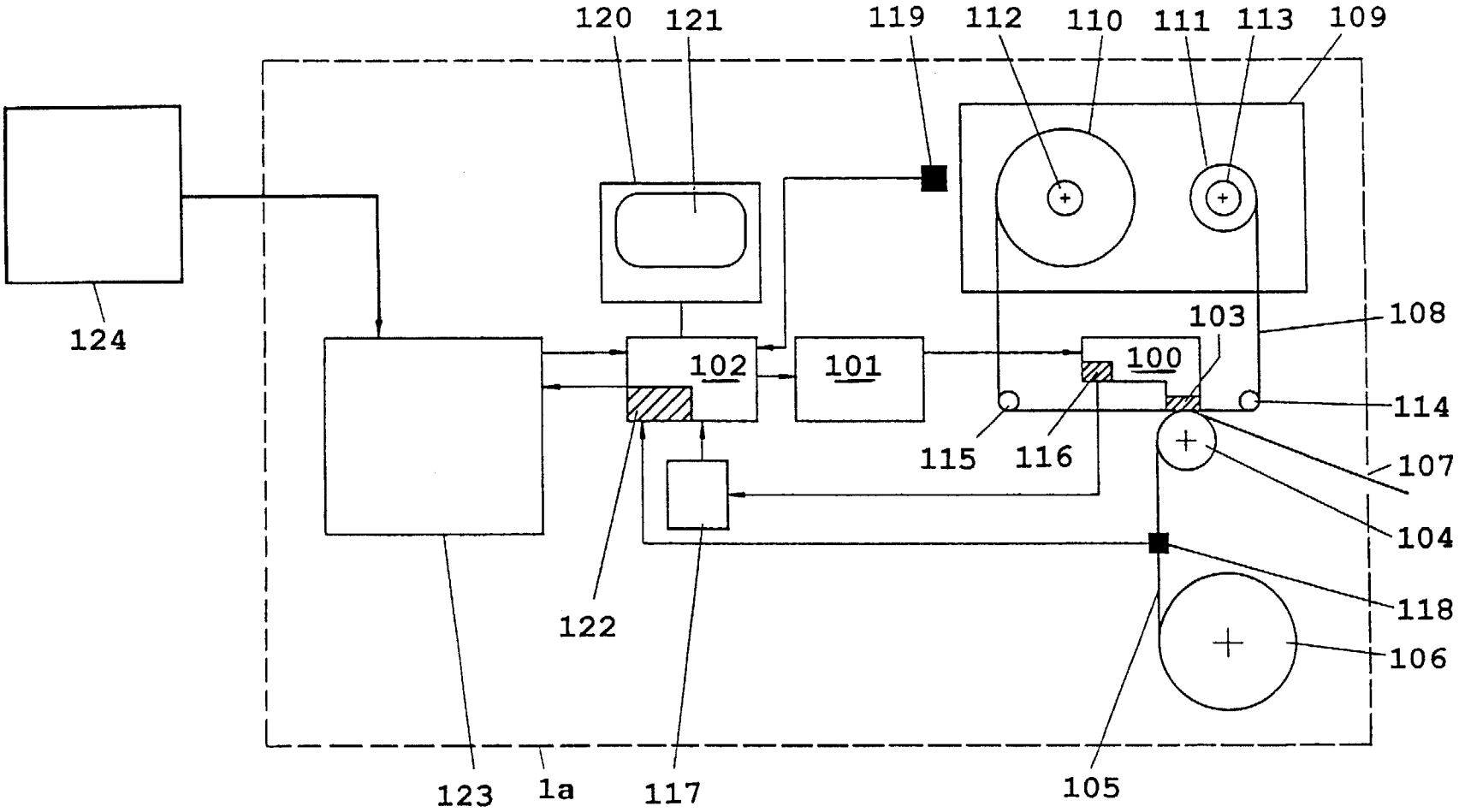
FIG. 1*b* shows schematically various components of a printer.

In accordance with one embodiment of the present invention, FIG. 1*b* shows schematically the various components 1*a* of the thermal printer shown in FIG. 1*a*, but shows the components 1*a* in further detail. Generally, the thermal printer can have a print head 100 which can be electrically connected by means of a control circuit 101 to a computer processor 102. Preferably on the underside of the print head 100 there can be electrically activated heating elements 103, which heating elements 103 can be maintained in contact against a counterpressure roller 104. A sheet of paper 105, or alternatively a strip of labels, can be introduced between the heating elements 103 and the counterpressure roller 104. As the paper 105 is printed, the paper 105 can preferably be unrolled by means of a payoff reel 106. Of course, the paper 105 need not necessarily be in the form of a continuous roll, and therefore may be in the form of sheets of a particular size which can be stored in trays, which trays can be disposed so that each sheet of paper can be pulled from each tray into the housing to be printed. After having been printed with the desired printing information, the paper 105 can preferably be output by means of an outlet opening 107 of the printer. Further, at or near outlet 107, there can preferably be an output paper tray (not shown) for catching the paper product after the paper has been printed upon. Alternatively, the paper product may move directly into a paper cutter, a paper stacker, or could be taken up by a take-up roller in the case of a printing of labels, etc.

A thermal transfer ink ribbon 108 can also be included between the paper 105 and the heating elements 103. The thermal transfer ink ribbon 108 can be coated essentially with temperature sensitive ink, which ink is preferably configured to melt at the points where it is moved past heated heating elements 103. The melted ink can then adhere to the paper 105 to thereby form the desired printed image.

Such a thermal transfer ink ribbon 108 can preferably be housed in a cassette 109, which cassette 109 can preferably have a payoff reel 110 and a takeup reel 111 therein. The cassette 109 can generally be positioned within the printer by means of devices 112 and 113, which devices 112 and 113 are preferably configured to fit into, or hold the reels 110 and 111. The printer can also preferably have deflector rollers 114 and 115, preferably disposed within the housing, to direct the path of the ink transfer ribbon 108 past the print head 100, and past the heating elements 103. Such deflector rollers 114 and 115 can make certain that the thermal transfer ink ribbon 108 is moved past the heating elements 103 at the optimum angle for transferring the ink to the paper with which it is in contact at the print head 100.

The print head 100 can be equipped with a temperature sensor 116 to transmit an analog electrical signal corresponding to the temperature of the print head 100 to an analog-digital (A-D) converter 117. This A-D converter 117 can then digitize the temperature signal and transmit the digitized signal to the processor 102.

The processor 102 can also preferably be connected to a paper sensor 118, which paper sensor 118 can be, for example, a photoelectric cell which detects the presence of paper 105, and reports the presence or absence of paper 105 to the processor 102. The processor 102 can also preferably be electrically connected to an ink ribbon sensor 119. This ink ribbon sensor 119 can also preferably be designed as a photoelectric cell to detect the presence of thermal transfer ink ribbon 108. Photoelectric cells are generally well known in the art and will not be discussed further here. Other types of detection devices would also be conceivable, and substitutions thereof would be well within the skill of the artesian.

In order to make the printer more "user-friendly", the processor 102 can preferably be connected to an optical data output medium 120. Such an output device 120 could provide an LCD screen 121 for displaying variables which the operator may have to adjust, or to alternatively display control commands for operation of the printer.

The processor 102 can also be equipped with a working memory, 122 the capacity of which is preferably sufficient to buffer control data supplied both by a read/write memory 123 connected to the processor 102, and also by the paper sensor 118, and by the ink ribbon sensor 119 during a printing process. The processor 102 can preferably use this information to control the printer. With such a working memory 122, the processor 102 could essentially operate at higher speeds, and data transfer between the read/write memory 123 and the processor 102 would need not to continuously take place.

The read/write memory 123 could be partitioned into several areas (not shown) depending on the particular features of the printer. For example, each memory area could be used to store different types of data, such as a data matrix corresponding to the various types of paper which are usable with the printer. Another area could be used to store the printing speed, and another area could be used to store the ink ribbon data corresponding to the various types of paper usable with the printer. These types of memory functions are well known in the art and will not be further discussed here. The information, or data matrix which is preferably stored in the various memory areas can preferably be entered into the read/write memory 123 by means of a data input device 124. Such an input device 124 could essentially be a personal computer, a scanner, a portable laptop computer, a keyboard, a card reader device, or any other type of input mechanism which is commonly used for entering data values into printers.

It should be understood that FIG. 1*b* shows only one type of printer which could be utilized in accordance with the present invention, and that other embodiments are conceivable.

FIGS. 2*b*–2*i* show substantially the same view as FIG. 2*a*, but show various peripheral devices which could be utilized in accordance with the present invention.

Figure 3:
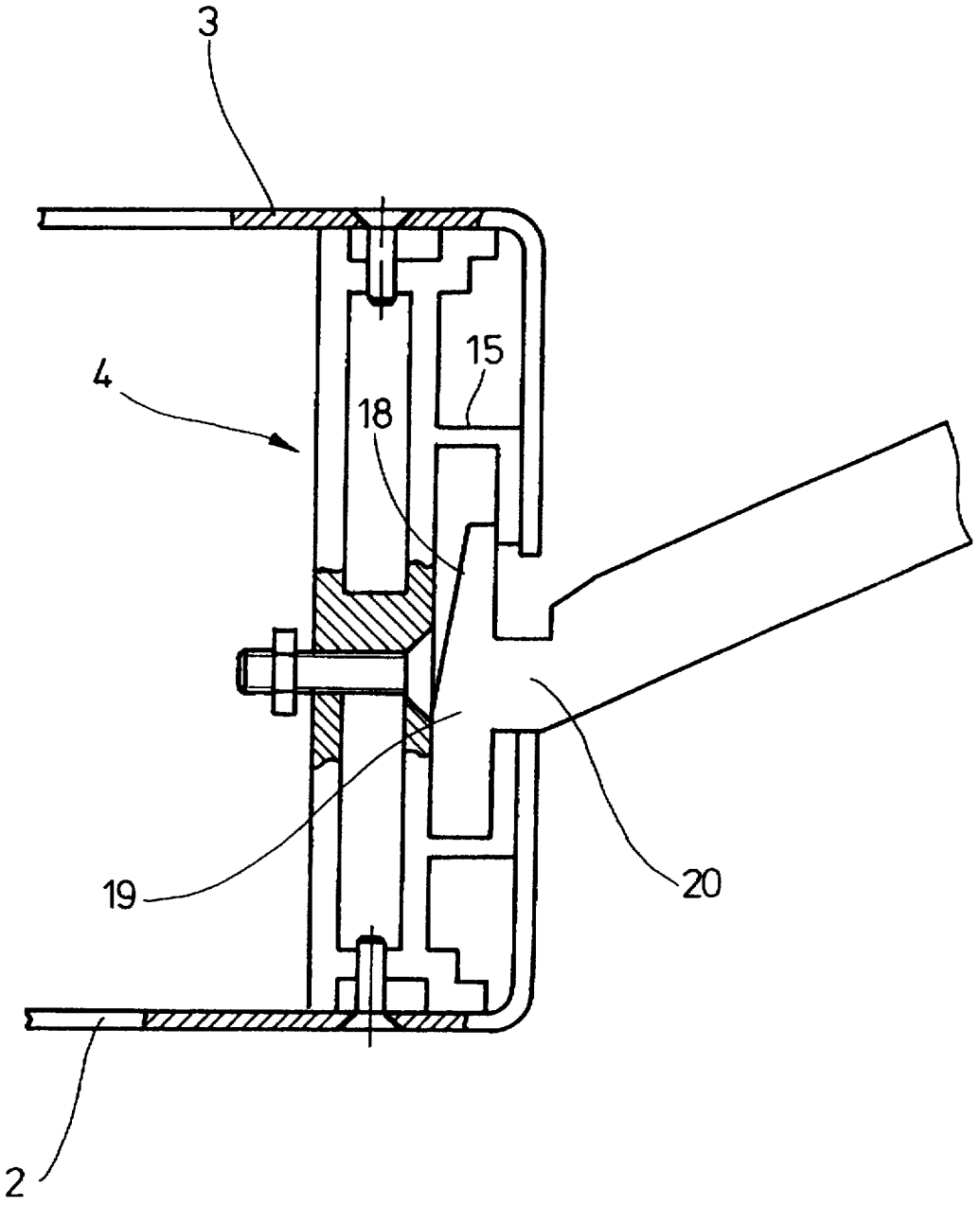
FIG. 3 shows a partial longitudinal cross section as in FIG. 2 through an additional embodiment of an anchoring element with a schematically indicated peripheral device, in an enlarged view.

FIG. 3 shows an additional embodiment of the present invention in a longitudinal section taken along Line II—II of FIG. 1. FIG. 3 essentially shows only one part of the profile element 4 with the locator device 15 in the form of a T-slot. In this embodiment, the peripheral device 8 is not fastened to an anchor plate 5, as shown in the other figures, but is instead mounted preferably by means of a neck 20 having a retaining plate 19 provided on the neck 20, the retaining plate 19 preferably being inserted into the T-slot. This retaining plate 19 is not inserted, like the anchor plate 5, from the side into the T-slot, but is instead preferably suspended or raised upwardly into the T-slot, and is then preferably lowered from the front. For this purpose, the retaining plate 19 can preferably be provided with a bevel 18 in the upper area on the long side 19*a* (see FIG. 3*a*) opposite the peripheral device 8.

Figure 3A:
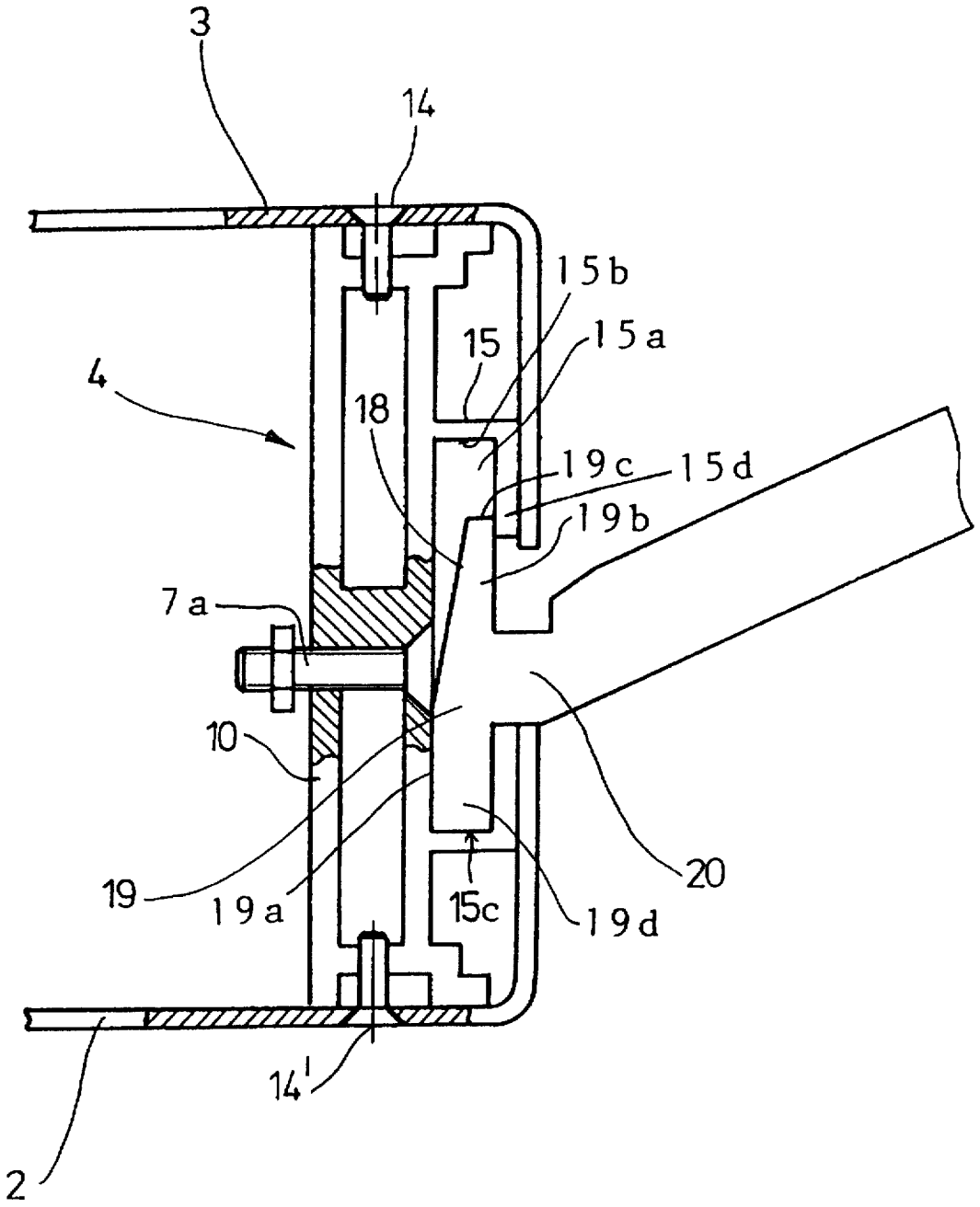
FIG. 3*a* shows substantially the same view as FIG. 3, but shows additional components.

In other words, as shown in FIG. 3*a*, a portion 19*b* of retaining plate 19 can preferably be inserted first into an upper portion 15*a* of the T-slot, so that surface 19*c* is raised towards surface 15*b* and so that a lower portion 19*d* of retaining plate 19 can then be tilted through the slot 1'. Retaining plate 19 can then be moved or slid downward so that the lower portion 19*d* of retaining plate 19 can eventually make contact with an additional surface 15*c*, preferably of the locator device 15. The upper portion 19*b* of retaining plate 19 can preferably be configured to contact a portion 15*d* of the T-slot to thereby limit downward tilting of the neck 20. A peripheral device 8 can then preferably be attached to neck 20 by a suitable method. Alternatively, neck 20 and retaining plate 19 may be a part of the particular peripheral device 8.

Naturally, other methods of fastening are also conceivable, depending on which type of peripheral device 8 is to be attached. It is also possible, for example, to insert, screw in, or snap in a peripheral device 8.

The present invention also makes it possible to detachably fasten one or more peripherals 8 to one and the same locator device 15 on a printer housing 1, so that, as necessary, they can be installed and removed easily. Numerous peripheral devices 8 can also be fastened simultaneously on at least two sides of the housing 1.

The connecting elements 4 thereby preferably form a connection between the two housing parts 2 and 3, and also provide a connection between the peripheral device 8 and the printer housing 1.

Preferably by means of the screw 7, or a screw 7a as shown in FIG. 3*a*, additional components can be fastened inside the printer housing, whereby the screw 7 or 7*a* can remain virtually invisible from outside the housing 1. For example, a takeup roller (not shown) could possibly be mounted inside the printer housing 1 by means of the screw 7*a*. The plate 10 can then function as a stop.

The anchor element 5 of the present invention, can, in accordance with at least one embodiment of the present invention, have a height of approximately 2 cm. However, the height of the anchor element 5 may vary depending on the size of the printer, and therefore may have a value of about 3 cm or less, 3.5 cm, 4 cm, 4.5 cm, 5 cm, 5.5 cm, 6 cm, 6.5 cm, 7 cm, 7.5 cm, 8 cm, or larger. The anchor element 5 may have a width of about 0.5 cm, however, the width may vary depending on the particular printer. Thus, the width of the anchor element 5 may have a value of about 1 cm or less, 1.5 cm, 2 cm, 2.5 cm, 3 cm, 3.5 cm, 4 cm, 4.5 cm, 5 cm or larger. The anchor element 5 may have a length of about 9.5 cm, however, the length may vary depending on the size of the printer and also on the number of anchor elements 5 utilized. Thus, the length of the anchor element 5 may have a value of about 2 cm or less, 2.5 cm, 3 cm, 3.5 cm, 4 cm, 4.5 cm, 5 cm, 5.5 cm, 6 cm, 6.5 cm, 7 cm, 7.5 cm, 8 cm, 8.5 cm, 9 cm, 9.5 cm, 10 cm, 10.5 cm, 11 cm, 11.5 cm, 12 cm, 12.5 cm, 13 cm, 13.5 cm, 14 cm, 14.5 cm, 15 cm or larger. Further, the slot 1' may have a height of about 0.5 cm, however, the height of the slot 1' may vary depending on the printer size. Thus, the height of the slot 1' may have a value of about 1 cm or less, 1.5 cm, 2 cm, 2.5 cm, 3 cm, 3.5 cm, 4 cm, 4.5 cm, 5 cm or larger.

One feature of the invention resides broadly in the printer, in particular a dot matrix impact, ink jet, laser or thermal transfer printer, with a printer housing 1 and at least one connecting element 4 provided on the printer housing 1, which connecting element 4 has a locator device 15 for an anchoring element 5 of an additional device or a peripheral 8, characterized by the fact that the printer housing 1 consists of at least two housing parts 2, 3 which are connected to one another by means of the connecting element 4 so that they form a slot 1', through which the locator device 15 is accessible.

Another feature of the invention resides broadly in the printer, characterized by the fact that the locator device 15 is accessible from outside.

Yet another feature of the invention resides broadly in the printer, characterized by the fact that the connecting element 4 is manufactured as one piece with the locator device 15.

Still another feature of the invention resides broadly in the printer, characterized by the fact that the locator device 15 is designed as a T-slot.

Yet still another feature of the invention resides broadly in the printer, characterized by the fact that at least one anchoring element 5 can be fastened to or in the locator device 15 of the connecting element 4.

Another feature of the invention resides broadly in the printer, characterized by the fact that the anchoring element 5 can be detachably fastened, in particular by clamping, bolting, suspending, snapping etc. it onto or into the connecting element 4.

Yet another feature of the invention resides broadly in the printer, characterized by the fact that the anchoring element 5 is an anchor plate, preferably a flat steel anchor plate.

Still another feature of the invention resides broadly in the printer, characterized by the fact that at least one peripheral device 8 can be connected to the anchoring element 5.

Still yet another feature of the invention resides broadly in the printer, characterized by the fact that the peripheral device 8 can be detachably fastened to the anchoring element 5.

Yet still another feature of the invention resides broadly in the printer, characterized by the fact that the peripheral device 8 is detachably connected to the locator device 15, in particular by bolting, screwing it in, suspending it or snapping it in.

Types of impact dot matrix printers, and non-impact dot matrix printers which may be utilized in accordance with the present invention are disclosed in the following U.S. Pat. Nos. 4,653,941 to Suzuki on Mar. 31, 1987, entitled "Impact Dot Matrix Printer"; 4,866,326 to Niikawa et al. on Sep. 12, 1989, entitled "Driver Circuit for Piezoelectric Actuator, and Impact Dot-Matrix Printer Using the Driver Circuit"; and 4,441,112 to Keller on Apr. 3, 1984, entitled "Non-impact Dot Matrix Printer".

Types of ink jet printers which could be utilized in accordance with the present invention are disclosed in the following U.S. Pat. Nos. 5,331,339 to Takahashi on Jul. 19, 1994, entitled "Ink Jet Printer"; 5,300,950 to Lopez et al. on Apr. 5, 1994, entitled "Interlaced Ink Jet Printer"; 5,294,946 to Gandy et al. on Mar. 15, 1994, entitled "Ink Jet Printer"; and 5,305,016 to Quate on Apr. 19, 1994, entitled "Traveling Wave Ink Jet Printer With Drop-on Demand Droplets".

Types of laser printers which could be utilized in accordance with the present invention are disclosed in the following U.S. Pat. Nos. 5,239,313 to Marko et al. on Aug. 24, 1993, entitled "Continuously Variable Resolution Laser Printer"; 5,229,790 to Matsuura et al. on Jul. 20, 1993, entitled "Laser Printer With Parameter Switching in Accordance With Scanning Density"; and 5,245,442 to Yang on Sep. 14, 1993, entitled "Multi-functional Laser Printer".

Types of thermal transfer printers which could be utilized in accordance with the present invention are disclosed in the following U.S. Pat. Nos. 5,305,020 to Gibbons et al. on Apr. 19, 1994, entitled "Thermal Transfer Printer Having Media Pre-coat Selection Apparatus and Methods"; 5,325,113 to Takeda on Jun. 28, 1994, entitled "Resistive Sheet Thermal Transfer Printer"; and 5,259,680 to Shimizu et al. on Nov. 9, 1993, entitled "Thermal Transfer Printer and Ink Sheet Cassette for Use in Same".

Types of thermal printers which could be utilized in accordance with the present invention are disclosed in the following U.S. Pat. Nos. 5,319,390 to Watanabe et al. on Jun. 7, 1994, entitled "Thermal Printer Apparatus"; 5,296,874 to Nagata et al. on Mar. 22, 1994, entitled "Thermal Printer"; and 5,321,426 to Baek et al. on Jun. 14, 1994, entitled "Scan Laser Thermal Printer".

Types of paper cutters which could be utilized in conjunction with the present invention are disclosed in the following U.S. Pat. Nos. 4,993,856 to Chung on Feb. 19, 1991, entitled "Paper Cutting Device for a Printer"; 4,491,046 to Hosogaya on Jan. 1, 1985, entitled "Paper Cutting Device for a Printer"; 3,956,954 to Edwards on May 18, 1976, entitled "Rotary Paper Cutting Device"; and 5,296,872 to Caamarro on Mar. 22, 1994, entitled "Cutting Device for a Plotter".

Types of label cutters which could be utilized in conjunction with the present invention are disclosed in the following U.S. Pat. Nos. 4,823,660 to Forthmann on Apr. 25, 1989, entitled "Label Cutting Device and Method"; and 4,094,724 to Sato on Jun. 13, 1978, entitled "Label Cutting Device for Label Applying Machine".

Types of paper stackers which could be utilized in conjunction with the present invention are disclosed in the following U.S. Pat. Nos. 4,460,350 to Mittal et al. on Jul. 17, 1984, entitled "Continuous Printed Paper Stacking Device"; 4,405,125 to Kulpa et al. on Sep. 20, 1983, entitled "Paper Stacking Device"; 4,737,045 to Koefferlein on Apr. 12, 1988, entitled "Paper Web Stacking Controlled by Electronic Motor Controlled by Form Length"; and 5,074,836 to Fechner et al. on Dec. 24, 1991, entitled "Automated Stacker for Previously Fan Folded for Continuous Feed Print Media".

Types of paper feeders which could be utilized in conjunction with the present invention are disclosed in the following U.S. Pat. Nos. 5,092,573 to Abreu on Mar. 3, 1992, entitled "Auxiliary Paper Feeding Apparatus for High Speed Computer Printers"; and 4,735,437 to Fattibene on Apr. 5, 1988, entitled "Quick Tear Tractor Feed Computer Paper".

Types of stackers for fan folded paper which could be utilized in conjunction with the present invention are disclosed in the following U.S. Pat. Nos. 4,416,653 to Breski et al. on Nov. 22, 1983, entitled "Apparatus for Stacking Fan-folded Paper"; and 4,054,283 to Rayfield on Oct. 18, 1977, entitled "Fan Fold Form Stacker".

Types of paper winders which could be used in conjunction with the present invention are disclosed in the following U.S. Pat. Nos. 4,669,678 to Navarro on Jun. 2, 1987, entitled "Paper Winding Device"; and 4,227,658 to Justus on Oct. 14, 1980, entitled "Paper Winder Assembly Including Pressure Modulating Valve".

Types of rollers which may be used in conjunction with the present invention are disclosed in the following U.S. Pat. Nos. 4,844,638 to Kagami et al. on Jul. 4, 1989, entitled "Paper Feeder for a Printer"; 4,642,656 to Shibuya et al. on Feb. 10, 1987, entitled "Thermal Printer"; and 4,591,141 to Wentzel et al. on May 27, 1986, entitled "Pivot Point Sheet Feeder".

Types of personal computers which may be used in conjunction with the present invention are disclosed in the following U.S. Pat. Nos. 5,315,695 to Saito et al. on May 24, 1994, entitled "Personal Computer Capable of Altering Display Luminance Through Key Operation"; 5,313,593 to Barakat et al. on May 17, 1994, entitled "Personal Computer System With Bus Noise Rejection"; and 5,297,725 to Thayer on Mar. 22, 1994, entitled" Personal Computer System Variable Resolution Timers".

Types of scanners which may be used in conjunction with the present invention are disclosed in the following U.S. Pat. Nos. 5,329,103 to Rando on Jul. 12, 1994, entitled "Laser Beam Scanner With Low Cost Ditherer Mechanism"; 5,329,382 to Mita on Jul. 12, 1994, entitled "Image Scanner"; and 5,291,592 to Kita on Mar. 1, 1994, entitled "System Having Document Scanner for Optically Scanning Information Whereby a First Information Contains Control Information Indicating a Number of Sheets to be Scanned".

Types of keyboards which may be used in conjunction with the present invention are disclosed in the following U.S. Pat. Nos. 5,334,976 to Wang on Aug. 2, 1994, entitled "Keyboard With Finger-actuable and Stylus-actuable Keys"; 5,331,508 to Hosoi et al. on Jul. 19, 1994, entitled "Portable Electronic Apparatus Having a Removable Keyboard Unit"; and 5,329,079 to English on Jul. 12, 1994, entitled "Computer Keyboard With Improved Cantilever Switch Design".

Types of card-reading devices which may be used in conjunction with the present invention are disclosed in the following U.S. Pat. Nos. 5,331,139 to Lee on Jul. 19, 1994, entitled "Card Reader With Antiabrasion Member"; 5,331,144 to Shima et al. on Jul. 19, 1994, entitled "Card Reader-Writer"; and 5,321,243 to Groves et al. on Jun. 14, 1994, entitled "Card Reader Apparatus With Read Head Mounting Structure and Card Guide".

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and all of the publications recited in all of the publications recited herein, and in the Declaration attached hereto, are hereby incorporated by reference as if set forth in their entirety herein.

The corresponding foreign patent publication applications, namely, Federal Republic of Germany Patent Application No. P 43 32 575.0, filed on Sep. 24, 1993, having inventor Dirk Umbach, and DE-OS P 43 32 575.0 and DE-PS P 43 32 575.0, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

Nomenclature

1 Printer housing
1' Slot
2 Bottom housing part
3 Top housing part
4 Profile element
4' Profile element
5 Flat steel anchor plate
6, 7 Screws
6', 7' Threaded holes
**7*a*** Additional screw
8 Peripheral device
9 Front plate
10 Rear plate
' Extensions
11 Middle transverse web
12 Upper transverse web
12' Lower transverse web
13 Upper support element
**13*a*** Stepped portion
**13*b*** Stepped portion
13' Lower support element
**13*a*'** Stepped portion
**13*b*'** Stepped portion
14, 14' Screws
15 T-slot
**15*a*** Upper portion of T-slot
**15*b*** Surface of T-slot
**15*c*** Surface of T-slot
**15*d*** Portion of T-slot
16 Lower rail
17 Upper rail
18 Bevel
19 Retaining plate
**19*a*** Side of retaining plate
**19*b*** Upper portion of retaining plate
**19*c*** Surface of retaining plate
**19*d*** Lower portion of retaining plate
20 Neck
100 Print head
101 Control Circuit
102 Computer processor
103 Heating elements
104 Counterpressure roller
105 Paper
106 Payoff reel
107 Outlet opening
108 Thermal transfer ink ribbon
109 Cassette
110 Payoff reel
111 Outlet opening
112 Device
113 Device
114 Deflector roller
115 Deflector roller
116 Temperature sensor
117 A-D converter
118 Paper sensor
119 Ink ribbon sensor
120 Output medium
121 LCD screen
122 Working memory
123 Read/write memory
124 Input device

What is claimed is:

1. A printer, such as a retail printer, for printing an image on a carrier, said printer comprising:

a housing;

means for printing an image onto a carrier;

said printing means being disposed at said housing;

means for moving at least one of: the carrier and said printing means relative to one another;

means for attaching at least one peripheral device to said housing;

said means for attaching comprising:

means for anchoring the at least one peripheral device to said housing;

means for retaining said anchoring means at said housing, said retaining means comprising:

slot means for receiving said anchoring means;

said slot means having a length and a width transverse to said length, said length being greater than said width;

said slot means being disposed along at least a portion of said housing; and said slot means for permitting said anchoring means to be slidably movable within and along said length of said slot means.

2. The printer according to claim 1 wherein said housing comprises:

a length and a width transverse to the length of said housing, said length of said housing being greater than said width of said housing;

an interior surface portion and an exterior surface portion;

said interior surface portion and said exterior surface portion are disposed to face away from one another;

said slot means extends through said housing from said exterior surface portion to said interior surface portion; and said slot means extends along said length of said housing, said length of said slot means being parallel to, and equal to, said length of said housing.

3. The printer according to claim 2 wherein: said slot means comprises:

a first slot portion disposed adjacent said interior surface portion of said housing, said first slot portion having a width dimension transverse to said length of said slot means;

a second slot portion disposed adjacent said first slot portion, said second slot portion extending from said exterior surface portion to said interior surface portion;

said second slot portion having a width dimension transverse to said length of said slot means, said width dimension of said first slot portion being greater than said width dimension of said second slot portion such that said first slot portion and said second slot portion together form a substantially T-shaped portion; and said anchoring means comprises a portion for being engaged in at least a portion of said T-shaped portion.

4. The printer according to claim 3 wherein:

said housing further comprises:
- a first part;
- a second part;
- said first part comprises:
  - at least a first part of said interior surface portion;
  - at least a first part of said exterior surface portion; said second part comprises:
  - at least a second part of said interior surface portion;
  - at least a second part of said exterior surface portion;

said attaching means further comprises:
- means for fastening said first part of said housing and said second part of said housing to one another to form at least a portion of said second slot portion; and
- said at least a portion of said second slot portion is disposed between said first part of said housing and said second part of said housing.

5. The printer according to claim 4 wherein said printer further comprises means for detachably fastening said anchoring means within said T-shaped portion of said slot means.

6. The printer according to claim 5 wherein said anchoring means comprises:

an anchor plate;

said anchor plate comprises:
- a first side;
- a second side;

said first side and said second side comprise substantially flat portions;

said first side and said second side are disposed to face away from one another;

to said width of said anchor plate, and a thickness; a width, a length transverse said first slot portion comprises:

a length dimension transverse to said width dimension of said first slot portion, and a depth;

said anchor plate is disposed within said first slot portion;

said width dimension of said first slot portion and said width of said anchor plate are substantially similar; and said depth of said first slot portion and said thickness of said anchor plate are substantially similar.

7. The printer according to claim 6 wherein said anchor plate comprises means for detachably fastening the at least one peripheral device to said anchor plate.

8. The printer according to claim 5 wherein said anchoring means further comprises:

a first portion disposed substantially within said first slot portion;

a second portion disposed substantially within said second slot portion; and said second portion of said anchoring means comprises an extension extending from said first portion of said anchoring means for mounting the at least one peripheral device on said housing.

9. The printer according to claim 7 wherein:

said fastening means of said attaching means and said retaining means comprise an integral piece;

said anchor plate further comprises a portion comprising steel;

said fastening means of said attaching means further comprises:
- a first bolt for fastening said fastening means of said attaching means to said first part of said housing;
- a second bolt for fastening said fastening means of said attaching means to said second part of said housing;

said printer further comprises one of the following a), b), c) and d):
- a) a dot matrix impact printer;
- b) an ink jet printer;
- c) a laser printer; and
- d) a thermal transfer printer;

said retaining means comprises a first portion and a second portion;

said first portion of said retaining means extends from said fastening means of said attaching means to said interior surface portion of said housing;

said first portion of said retaining means is substantially perpendicular to said fastening means of said attaching means;

said second portion of said retaining means extends from said fastening means of said attaching means to said interior surface portion of said housing;

said second portion of said retaining means is substantially perpendicular to said fastening means of said attaching means;

said first portion of said retaining means and said second portion of said retaining means are disposed substantially parallel to one another and at a distance from one another;

said first portion of said retaining means comprises:
- a first end and a second end;
- said first end of said first portion of said retaining means is disposed at said fastening means of said attaching means;
- said second end of said first portion of said retaining means is disposed at said interior surface portion of said housing;
- an extension extending from said second end of said first portion of said retaining means towards said second portion of said retaining means;
- said extension of said first portion of said retaining means is substantially perpendicular to said first portion of said retaining means;

said second portion of said retaining means comprises:
- a first end and a second end;

said first end of said second portion of said retaining means is disposed at said fastening means of said attaching means;

said second end of said second portion of said retaining means is disposed at said interior surface portion of said housing;

an extension extending from said second end of said second portion of said retaining means towards said first portion of Said retaining means;

said extension of said second portion of said retaining means is substantially perpendicular to said second portion of said retaining means;

said first side of said anchor plate is disposed immediately adjacent said fastening means of said attaching means;

said anchor plate further comprises:

a first edge extending between said first side and said second side and parallel to said width of said anchor plate;

a second edge extending between said first side and said second side and parallel to said width of said anchor plate;

said first edge and said second edge are disposed a distance from one another;

said first edge of said anchor plate is configured to contact at least a portion of said first portion of said retaining means and at least a portion of said extension of said first portion of said retaining means;

said second edge of said anchor plate is configured to contact at least a portion of said second portion of said retaining means and at least a portion of said extension of said second portion of said retaining means;

said fastening means of said attaching means comprises:

a first end portion;

a second end portion;

said first end portion is configured to contact said first part of said housing;

said second end portion is configured to contact said second part of said housing;

said first end portion for supporting said first part of said housing;

said second end portion for supporting said second part of said housing;

said attaching means further comprises:

at least two attaching means disposed at a distance from one another within said housing;

said first end portion comprises a stepped portion disposed immediately adjacent said interior surface portion of said first housing part;

said second end portion comprises a stepped portion disposed immediately adjacent said interior surface portion of said second housing part;

said fastening means of said attaching means further comprises:

a first orifice;

a second orifice;

a partition disposed between said first orifice and said second orifice; and said partition is disposed substantially parallel to said first portion of said retaining means and said second portion of said retaining means.

10. The printer according to claim 8 wherein:

said retaining means comprises a first portion and a second portion;

said first portion of said retaining means extends from said fastening means to said interior surface portion of said housing;

said first portion of said retaining means is substantially perpendicular to said fastening means of said attaching means;

said second portion of said retaining means extends from said fastening means of said attaching means to said interior surface portion of said housing;

said second portion of said retaining means is substantially perpendicular to said fastening means of said attaching means;

said first portion of said retaining means and said second portion of said retaining means are disposed substantially parallel to one another and at a distance from one another;

said first portion of said retaining means comprises:

a first end and a second end;

said first end of said first portion of said retaining means is disposed at said fastening means of said attaching means;

said second end of said first portion of said retaining means is disposed at said interior surface portion of said housing;

an extension extending from said second end of said first portion of said retaining means towards said second portion of said retaining means;

said extension of said first portion of said retaining means is substantially perpendicular to said first portion of said retaining means;

said second portion of said retaining means comprises:

a first end and a second;

said first end of said second portion of said retaining means is disposed at said fastening means of said attaching means;

said second end of said second portion of said retaining means is disposed at said interior surface portion of said housing;

an extension extending from said second end of said second portion of said retaining means towards said first portion of said retaining means;

said extension of said second portion of said retaining means is substantially perpendicular to said second portion of said retaining means;

said first portion of said anchoring means comprises:

an anchor plate;

said anchor plate comprises:

a width, a length transverse to said width of said anchor plate, and a thickness;

a first side and a second side disposed to face away from one another;

a first edge extending between said first side and said second side and parallel to said width of said anchor plate;

a second edge extending between said first side and said second side and parallel to said width of said anchor plate;

said first edge and said second edge are disposed a distance from one another;

said first edge is substantially perpendicular to said first side and said second side;

said second edge is substantially perpendicular to said first side and said second side;

said first edge of said anchor plate is configured to contact at least a portion of said first portion of said retaining means;

said second edge of said anchor plate is configured to contact at least a portion of said second portion of said retaining means;

said first side of said anchor plate is disposed immediately adjacent said fastening means;

said first side of said anchor plate comprises a beveled portion;

said fastening means of said attaching means and said retaining means comprise an integral piece;

said anchor plate further comprises a portion comprising steel;

said fastening means of said attaching means further comprises:

first bolt for fastening said fastening means to said first part of said housing;

a second bolt for fastening said fastening means to said second part of said housing;

said printer further comprises one of the following a), b), c) and d):

a) a dot matrix impact printer;

b) an ink jet printer;

c) a laser printer; and d) a thermal transfer printer;

said first side of said anchor plate is disposed immediately adjacent said fastening means of said attaching means;

said fastening means of said attaching means comprises:

a first end portion;

a second end portion;

said first end portion is configured to contact said first part of said housing;

said second end portion is configured to contact said second part of said housing;

said first end portion for supporting said first part of said housing;

said second end portion for supporting said second part of said housing;

said attaching means further comprises:

at least two attaching means disposed at a distance from one another within said housing;

said first end portion comprises a stepped portion disposed immediately adjacent said interior surface portion of said first housing part;

said second end portion comprises a stepped portion disposed immediately adjacent said interior surface portion of said second housing part;

said fastening means of said attaching means further comprises:

a first orifice;

a second orifice;

a partition disposed between said first orifice and said second orifice; and said partition is disposed substantially parallel to said first portion of said retaining means and said second portion of said retaining means.

11. A method of attaching at least one peripheral device to a printer, the printer comprising: a housing; means for printing an image onto a carrier; the printing means being disposed at the housing; means for moving at least one of: the carrier and the printing means relative to one another; means for attaching the at least one peripheral device to the housing; the means for attaching comprising: means for anchoring the at least one peripheral device to the housing; means for retaining the anchoring means at said housing, the retaining means comprising: slot means for receiving the anchoring means; the slot means having a length and a width transverse to said length, the length being greater than the width; the slot means being disposed along at least a portion of the housing; the slot means for permitting the anchoring means to be slidably movable within and along the length of the slot means; said method comprising the steps of:

providing the housing;

providing the printing means;

providing the carrier;

disposing the printing means at the housing;

providing the moving means;

providing the at least one peripheral device;

providing the attaching means, said step of providing the attaching means comprising:

providing the anchoring means;

providing the retaining means, said step of providing the retaining means comprising:

providing the slot means;

said method further comprising the steps of:

attaching the at least one peripheral device to the housing by:

disposing the anchoring means in the slot means;

moving the anchoring means within the slot means by sliding the anchoring means along the length of the slot means; and retaining the anchoring means in the slot means with the retaining means.

12. The method according to claim 11 wherein:

said housing has a length and a width transverse to said length of said housing, said length of said housing being greater than said width of said housing;

said step of providing said housing comprises:

providing an interior surface portion and an exterior surface portion;

said method further comprises the steps of:

disposing said interior surface portion and said exterior surface portion to face away from one another; extending said slot means through said housing from said exterior surface portion to said interior surface portion;

said step of providing said slot means comprises:

extending said slot means along said length of said housing, said length of said slot means being parallel to, and equal to, said length of said housing;

providing a first slot portion and disposing said first slot portion adjacent said interior surface portion of said housing, the first slot portion having a width dimension transverse to the length of the slot means;

providing a second slot portion and disposing said second slot portion adjacent to said first slot portion, said second slot portion extending from said exterior surface portion to said interior surface portion;

said second slot portion having a width dimension transverse to the length of said slot means, the width dimension of said first slot portion being greater than said width dimension of said second slot portion;

configuring said first slot portion and said second slot portion to together comprise a substantially T-shaped portion;

configuring said anchoring means to comprise a portion for being engaged in at least a portion of said T-shaped portion;

engaging said portion of said anchoring means in at least a portion of said T-shaped portion;

said step of providing said housing further comprises:

providing a first part;

providing a second part;

configuring said first part to comprise:

at least a first part of said interior surface portion; and at least a first part of said exterior surface portion;

configuring said second portion to comprise:

at least a second part of said interior surface portion; and at least a second part of said exterior surface portion;

said step of providing said attaching means further comprises:

providing means for fastening said first part of said housing and said second part of said housing to one another to form at least a portion of said second slot portion;

fastening, with the fastening means, said first part of said housing and said second part of said housing to one another to form at least a portion of said second slot portion;

disposing said at least a portion of said second slot portion between said first part of said housing and said second part of said housing;

configuring said printer to further comprise means for detachably fastening said anchoring means within said T-shaped portion;

detachably fastening said anchoring means within said T-shaped portion with said means for detachably fastening;

said method further comprises one of the following sets of steps A) and B):

A) said step of providing said anchoring means comprises:

providing an anchor plate;

said step of providing said anchor plate further comprises:

providing a first side;

providing a second side;

said step of providing said first side comprises providing a substantially flat portion;

said step of providing said second side comprises providing a substantially flat portion;

disposing said first side and said second side to face away from one another;

providing a width, a length transverse to said width of said anchor plate, and a thickness;

said step of providing said first slot portion comprises:

providing a length dimension transverse to said width dimension of said first slot portion, and a depth;

disposing said anchor plate within said first slot portion;

said width dimension of said first slot portion and said width of said anchor plate are substantially similar;

said depth of said first slot portion and said thickness of said anchor plate are substantially similar;

said step of providing said anchor plate comprises providing means for detachably fastening the at least one peripheral device to said anchor plate;

configuring said fastening means of said attaching means and said retaining means to comprise an integral piece;

detachably fastening the at least one peripheral device to said anchor plate with the means for detachably fastening;

configuring said anchor plate further to comprise a portion comprising steel;

said step of providing said fastening means of said attaching means further comprises:

providing a first bolt for fastening said fastening means to said first part of said housing;

fastening said fastening means of said attaching means to said first part of said housing with said first bolt;

providing a second bolt for fastening said fastening means to said second part of said housing;

fastening said fastening means of said attaching means to said second part of said housing with said second bolt;

configuring said printer to further comprise one of the following a), b), c) and d):

a) a dot matrix impact printer;

b) an ink jet printer;

c) a laser printer; and d) a thermal transfer printer;

said step of providing said retaining means comprises providing a first portion and a second portion;

extending said first portion of said retaining means from said fastening means to said interior surface portion of said housing;

said first portion of said retaining means is substantially perpendicular to said fastening means;

extending said second portion of said retaining means from said fastening means to said interior surface portion of said housing;

said second portion of said retaining means is substantially perpendicular to said fastening means;

disposing said first portion of said retaining means and said second portion of said retaining means substantially parallel to one another and at a distance from one another;

said step of providing said first portion of said retaining means comprises:

providing a first end and a second end;

disposing said first end of said first portion of said retaining means at said fastening means of said attaching means;

disposing said second end of said first portion of said retaining means at said interior surface portion of said housing;

providing an extension extending from said second end of said first portion of said retaining means towards said second portion of said retaining means;

said extension of said first portion of said retaining means is substantially perpendicular to said first portion of said retaining means;

said step of providing said second portion of said retaining means comprises:

providing a first end and a second end;

disposing said first end of said second portion of said retaining means at said fastening means;

disposing said second end of said second portion of said retaining means at said interior surface portion of said housing;

providing an extension extending from said second end of said second portion of said retaining means towards said first portion of said retaining means;

said extension of said second portion of said retaining means is substantially perpendicular to said second portion of said retaining means;

disposing said first side of said anchor plate immediately adjacent said fastening means; said step of providing said anchor plate further comprises:

providing a first edge extending between said first side and said second side and parallel to said width of said anchor plate;

providing a second edge extending between said first side and said second side and parallel to said width of said anchor plate;

disposing said first edge and said second edge a distance from one another;

configuring said first edge of said anchor plate to contact at least a portion of said first portion of said retaining means and at least a portion of said extension of said first portion of said retaining means;

configuring said second edge of said anchor plate to contact at least a portion of said second portion of said retaining means and at least a portion of said extension of said second portion of said retaining means;

said step of providing said fastening means of said attaching means comprises:

providing a first end portion; <providing a second end portion;

configuring said first end portion to contact said first part of said housing;

configuring said second end portion is to contact said second part of said housing;

supporting said first part of said housing with said first end portion;

supporting said second part of said housing with said second end portion;

said step of providing said attaching means further comprises:

providing at least two attaching means and disposing said at least two attaching means at a distance from one another within said housing;

said step of providing said first end portion comprises providing a stepped portion disposed immediately adjacent said interior surface portion of said first housing portion;

said step of providing said second end portion comprises providing a stepped portion disposed immediately adjacent said interior surface portion of said second housing portion;

said step of providing said fastening means of said attaching means further comprises:

providing a first orifice;

providing a second orifice;

providing a partition disposed between said first orifice and said second orifice;

disposing said partition substantially parallel to said first portion of said retaining means and said second portion of said retaining means; and B) said step of providing said anchoring means further comprises:

providing a first portion and disposing said first portion substantially within said first slot portion;

providing a second portion and disposing said second portion substantially within said second slot portion;

said step of providing said second portion of said anchoring means comprises providing an extension extending from said first portion of said anchoring means and mounting the at least one peripheral device on said housing with said extension;

said step of providing said retaining means comprises providing a first portion and a second portion;

extending said first portion of said retaining means from said fastening means to said interior surface .portion of said housing;

said first portion of said retaining means is substantially perpendicular to said fastening means;

extending said second portion of said retaining means from said fastening means to said interior surface portion of said housing;

said second portion of said retaining means is substantially perpendicular to said fastening means;

disposing said first portion of said retaining means and said second portion of said retaining means substantially parallel to one another and at a distance from one another;

said step of providing said first portion of said retaining means comprises:

providing a first end and a second end;

disposing said first end of said first portion of said retaining means at said fastening means of said attaching means;

disposing said second end of said first portion of said retaining means at said interior surface portion of said housing;

providing an extension extending from said second end of said first portion of said retaining means towards said second portion of said retaining means;

said extension of said first portion of said retaining means is substantially perpendicular to said first portion of said retaining means;

said step of providing said second portion of said retaining means comprises:

providing a first end and a second end; disposing said first end of said second portion of said retaining means at said fastening means;

disposing said second end of said second portion of said retaining means at said interior surface portion of said housing;

providing an extension extending from said second end of said second portion of said retaining means towards said first portion of said retaining means;

said extension of said second portion of said retaining means is substantially perpendicular to said second portion of said retaining means;

said step of providing said first portion of said anchoring means comprises:

providing an anchor plate;

configuring said anchor plate to comprise:

a width, a length transverse to said width of said anchor plate, and a thickness;

a first side and a second side;

disposing said first side and said second side to face away from one another;

a first edge;

extending said first edge between said first side and said second side and parallel to said width of said anchor plate;

a second edge;

extending said second edge between said first side and said second side and parallel to said width of said anchor plate;

disposing said first edge and said second edge a distance from one another;

said first edge is substantially perpendicular to said first side and said second side;

said second edge is substantially perpendicular to said first side and said second side;

configuring said first edge of said anchor plate to contact at least a portion of said first portion of said retaining means;

configuring said second edge of said anchor plate to contact at least a portion of said second portion of said retaining means;

disposing said first side of said anchor plate immediately adjacent said fastening means;

configuring said first side of said anchor plate to comprise a beveled portion;

configuring said fastening means of said attaching means and said retaining means to comprise an integral piece;

configuring said anchor plate further to comprise a portion comprising steel;

said step of providing said fastening means of said attaching means further comprises:

providing a first bolt for fastening said fastening means to said first part of said housing;

fastening said fastening means of said attaching means to said first part of said housing with said first bolt;

providing a second bolt for fastening said fastening means to said second part of said housing;

fastening said fastening means of said attaching means to said second part of said housing with said second bolt;

configuring said printer to further comprise one of the following a), b), c) and d):

a) a dot matrix impact printer;

b) an ink jet printer;

c) a laser printer; and d) a thermal transfer printer;

disposing said first side of said anchor plate immediately adjacent said fastening means;

said step of providing said anchor plate further comprises:

providing a first edge extending between said first side and said second side and parallel to said width of said anchor plate;

providing a second edge extending between said first side and said second side and parallel to said width of said anchor plate;

disposing said first edge and said second edge are distance from one another;

configuring said first edge of said anchor plate to contact at least a portion of said first portion of said retaining means and at least a portion of said extension of said first portion of said retaining means;

configuring said second edge of said anchor plate to contact at least a portion of said second portion of said retaining means and at least a portion of said extension of said second portion of said retaining means; said step of providing said fastening means of said attaching means comprises:

providing a first end portion;

providing a second end portion;

configuring said first end portion to contact said first part of said housing;

configuring said second end portion to contact said second part of said housing;

supporting said first part of said housing with said first end portion;

supporting said second part of said housing with said second end portion;

said step of providing said attaching means further comprises:

providing at least two attaching means and disposing said at least two attaching means at a distance from one another within said housing;

said step of providing said first end portion comprises providing a stepped portion disposed immediately adjacent said interior surface portion of said first housing portion;

said step of providing said second end portion comprises providing a stepped portion disposed immediately adjacent said interior surface portion of said second housing portion;

said step of providing said fastening means of said attaching means further comprises:

providing a first orifice;

providing a second orifice;

providing a partition disposed between said first orifice and said second orifice; and disposing said partition substantially parallel to said first portion of said retaining means and said second portion of said retaining means.

13. A printer, such as a retail printer, for printing an image on a carrier, said printer comprising:

a housing;

means for printing an image onto a carrier;

said printing means being disposed at said housing;

means for moving at least one of: the carrier and said printing means relative to one another;

means for attaching at least one peripheral device to said housing;

said means for attaching comprising:

means for anchoring the at least one peripheral device to said housing;

means for retaining said anchoring means at said housing, said retaining means comprising:

slot means for receiving said anchoring means;

said slot means having a length and a width transverse to said length, said length being greater than said width;

said slot means being disposed along at least a portion of said housing;

said slot means for permitting said anchoring means to be slidably movable within and along said length of said slot means; said housing comprising:

an interior surface portion and an exterior surface portion;

said interior surface portion and said exterior surface portion being disposed to face away from one another, said slot means extending through said housing from said exterior surface portion to said interior surface portion; said slot means comprising:

a first slot portion disposed adjacent said interior surface portion of said housing, said first slot portion having a width dimension transverse to said length of said slot means;

a second slot portion disposed adjacent said first slot portion, said second slot portion extending from said exterior surface portion to said interior surface portion; and said second slot portion having a width dimension transverse to said length of said slot means, said width dimension of said first slot portion being greater than said width dimension of said second slot portion such that said first slot portion and said second slot portion together form a substantially T-shaped portion.

14. The printer according to claim 13 wherein:

said housing further comprises:

a length and a width transverse to said length of said housing, said length of said housing being greater than said width of said housing;

a first part;

a second part;

said first part comprises:

at least a first part of said interior surface portion;

at least a first part of said exterior surface portion;

said second part comprises:

at least a second part of said interior surface portion; at least a second part of said exterior surface portion;

said slot means extends along said length of said housing, said length of said slot means being parallel to, and equal to, said length of said housing;

said attaching means further comprises:

means for fastening said first part of said housing and said second part of said housing to one another to form at least a portion of said second slot portion; and said at least a portion of said second slot portion is disposed between said first part of said housing and said second part of said housing.

15. The printer according to claim 14 wherein said fastening means of said attaching means and said retaining means comprise an integral piece.

16. The printer according to claim 15 wherein said printer further comprises means for detachably fastening said anchoring means within said T-shaped portion of said slot means.

17. The printer according to claim 16 wherein said anchoring means comprises:

an anchor plate;

said anchor plate comprises:

a first side;

a second side;

said first side and said second side comprise substantially flat portions;

said first side and said second side are disposed to face away from one another;

a width, a length transverse to said width of said anchor plate, and a thickness;

said first slot portion comprises:

a length dimension transverse to said width dimension of said first slot portion, and a depth;

said anchor plate is disposed within said first slot portion;

said width dimension of said first slot portion and said width of said anchor plate are substantially similar; and said depth of said first slot portion and said thickness of said anchor plate are substantially similar.

18. The printer according to claim 17 wherein said anchor plate comprises means for detachably fastening the at least one peripheral device to said anchor plate.

19. The printer according to claim 16 wherein said anchoring means further comprises:

a first portion disposed substantially within said first slot portion;

a second portion disposed substantially within said second slot portion; and said second portion of said anchoring means comprises an extension extending from said first portion of said anchoring means for mounting the at least one peripheral device on said housing;

said retaining means comprises a first portion and a second portion;

said first portion of said retaining means extends from said fastening means to said interior surface portion of said housing;

said first portion of said retaining means is substantially perpendicular to said fastening means of said attaching means;

said second portion of said retaining means extends from said fastening means of said attaching means to said interior surface portion of said housing;

said second portion of said retaining means is substantially perpendicular to said fastening means of said attaching means;

said first portion of said retaining means and said second portion of said retaining means are disposed substantially parallel to one another and at a distance from one another;

said first portion of said retaining means comprises:

a first end and a second end;

said first end of said first portion of said retaining means is disposed at said fastening means of said attaching means;

said second end of said first portion of said retaining means is disposed at said interior surface portion of said housing;

an extension extending from said second end of said first portion of said retaining means towards said second portion of said retaining means;

said extension of said first portion of said retaining means is substantially perpendicular to said first portion of said retaining means;

said second portion of said retaining means comprises:

a first end and a second end;

said first end of said second portion of said retaining means is disposed at said fastening means of said attaching means;

said second end of said second portion of said retaining means is disposed at said interior surface portion of said housing;

an extension extending from said second end of said second portion of said retaining means towards said first portion of said retaining means;

said extension of said second portion of said retaining means is substantially perpendicular to said second portion of said retaining means;

said first portion of said anchoring means comprises:

an anchor plate;

said anchor plate comprises:

a width, a length transverse to said width of said anchor plate, and a thickness;

a first side and a second side disposed to face away from one another;

a first edge extending between said first side and said second side and parallel to said width of said anchor plate;

a second edge extending between said first side and said second side and parallel to said width of said anchor plate;

said first edge and said second edge are disposed a distance from one another;

said first edge is substantially perpendicular to said first side and said second side;

said second edge is substantially perpendicular to said first side and said second side;

said first edge of said anchor plate is configured to contact at least a portion of said first portion of said retaining means;

said second edge of said anchor plate is configured to contact at least a portion of said second portion of said retaining means;

said first side of said anchor plate is disposed immediately adjacent said fastening means;

said first side of said anchor plate comprises a beveled portion;

said anchor plate further comprises a portion comprising steel;

said fastening means of said attaching means further comprises:

a first bolt for fastening said fastening means to said first part of said housing;

a second bolt for fastening said fastening means to said second part of said housing;

said printer further comprises one of the following a), b), c) and d):

a) a dot matrix impact printer;

b) an ink jet printer;

c) a laser printer; and d) a thermal transfer printer;

said first side of said anchor plate is disposed immediately adjacent said fastening means of said attaching means;

said fastening means of said attaching means comprises:

a first end portion;

a second end portion;

said first end portion is configured to contact said first part of said housing;

said second end portion is configured to contact said second part of said housing;

said first end portion for supporting said first part of said housing;

said second end portion for supporting said second part of said housing;

said attaching means further comprises:

at least two attaching means disposed at a distance from one another within said housing;

said first end portion comprises a stepped portion disposed immediately adjacent said interior surface portion of said first housing part;

said second end portion comprises a stepped portion disposed immediately adjacent said interior surface portion of said second housing part;

said fastening means of said attaching means further comprises:

a first orifice;

a second orifice; and a partition disposed between said first orifice and said second orifice; and said partition is disposed substantially parallel to said first portion of said retaining means and said second portion of said retaining means.

20. The printer according to claim 18 wherein:

said anchor plate further comprises a portion comprising steel;

said fastening means of said attaching means further comprises:

a first bolt for fastening said fastening means of said attaching means to said first part of said housing;

a second bolt for fastening said fastening means of said attaching means to said second part of said housing;

said printer further comprises one of the following a), b), c) and d):

a) a dot matrix impact printer;

b) an ink jet printer;

c) a laser printer; and d) a thermal transfer printer;

said retaining means comprises a first portion and a second portion;

said first portion of said retaining means extends from said fastening means of said attaching means to said interior surface portion of said housing;

said first portion of said retaining means is substantially perpendicular to said fastening means of said attaching means;

said second portion of said retaining means extends from said fastening means of said attaching means to said interior surface portion of said housing;

said second portion of said retaining means is substantially perpendicular to said fastening means of said attaching means; said first portion of said retaining means and said second portion of said retaining means are disposed substantially parallel to one another and at a distance from one another;

said first portion of said retaining means comprises:

a first end and a second end;

said first end of said first portion of said retaining means is disposed at said fastening means of said attaching means;

said second end of said first portion of said retaining means is disposed at said interior surface portion of said housing;

an extension extending from said second end of said first portion of said retaining means towards said second portion of said retaining means;

said extension of said first portion of said retaining means is substantially perpendicular to said first portion of said retaining means;

said second portion of said retaining means comprises:

a first end and a second end;

said first end of said second portion of said retaining means is disposed at said fastening means of said attaching means;

said second end of said second portion of said retaining means is disposed at said interior surface portion of said housing;

an extension extending from said second end of said second portion of said retaining means towards said first portion of said retaining means;

said extension of said second portion of said retaining means is substantially perpendicular to said second portion of said retaining means;

said first side of said anchor plate is disposed immediately adjacent said fastening means of said attaching means;

said anchor plate further comprises:

a first edge extending between said first side and said second side and parallel to said width of said anchor plate;

a second edge extending between said first side and said second side and parallel to said width of said anchor plate;

said first edge and said second edge are disposed a distance from one another;

said first edge of said anchor plate is configured to contact at least a portion of said first portion of said retaining means and at least a portion of said extension of said first portion of said retaining means;

said second edge of said anchor plate is configured to contact at least a portion of said second portion of said retaining means and at least a portion of said extension of said second portion of said retaining means; said fastening means of said attaching means comprises:

a first end portion;

a second end portion;

said first end portion is configured to contact said first part of said housing;

said second end portion is configured to contact said second part of said housing;

said first end portion for supporting said first part of said housing;

said second end portion for supporting said second part of said housing;

said attaching means further comprises:

at least two attaching means disposed at a distance from one another within said housing;

said first end portion comprises a stepped portion disposed immediately adjacent said interior surface portion of said first housing part;

said second end portion comprises a stepped portion disposed immediately adjacent said interior surface portion of said second housing part;

said fastening means of said attaching means further comprises:

a first orifice;

a second orifice;

a partition disposed between said first orifice and said second orifice; and said partition is disposed substantially parallel to said first portion of said retaining means and said second portion of said retaining means.

* * * * *

UNITED STATES PATENT AND TRADEMARK OFFICE

CERTIFICATE OF CORRECTION

PATENT NO. : 5,531,532

DATED : July 2, 1996

INVENTOR(S) : Dirk UMBACH

It is certified that error appears in the above-indentified patent and that said Letters Patent is hereby corrected as shown below:

In column 11, line 43, before 'Extensions', delete " ' " and insert --10'--.

In column 13, line 56, Claim 6, before 'to' insert --a width, a length transverse--.

In column 13, lines 56-57, Claim 6, after 'thickness;' delete "a width, a length transverse".

In column 15, line 9, Claim 9, after 'of', delete "Said" and insert --said--.

In column 17, line 11, Claim 10, before 'first' insert --a--.

In column 21, line 12, Claim 12, after 'portion;' delete "<providing" and insert --providing--.

Signed and Sealed this

Twenty-eighth Day of January, 199

*Attest:*

Bruce Lehman

BRUCE LEHMAN

*Attesting Officer* *Commissioner of Patents and Trademarks*